United States Patent [19]

Masuda

[11] 4,114,810

[45] Sep. 19, 1978

[54] ELECTROSTATIC POWDER PAINTING APPARATUS

[76] Inventor: Senichi Masuda, No. 605, 1-40-10, Nishigahara, Kita-ku, Tokyo, Japan

[21] Appl. No.: 728,711

[22] Filed: Oct. 1, 1976

[30] Foreign Application Priority Data

Oct. 3, 1975 [JP] Japan ..... 50-119577

[51] Int. Cl.[2] ..... B05B 5/02

[52] U.S. Cl. ..... 239/15

[58] Field of Search ..... 239/3, 15; 118/312, 118/629, 326; 361/226, 227, 228

[56] References Cited

U.S. PATENT DOCUMENTS

| | | | |
|---|---|---|---|
| 2,757,635 | 8/1956 | Lipsius | 118/312 |
| 3,448,925 | 6/1969 | Cross | 239/15 |
| 4,024,815 | 5/1977 | Platsch | 118/31 L X |

FOREIGN PATENT DOCUMENTS

| | | | |
|---|---|---|---|
| 213,919 | 3/1958 | Australia | 239/15 |
| 4,325,667 | 5/1968 | Japan | 239/15 |
| 319,350 | 1/1972 | U.S.S.R. | 239/15 |

*Primary Examiner*—John J. Love
*Attorney, Agent, or Firm*—Steinberg & Blake

[57] ABSTRACT

An electrostatic powder painting apparatus has a cyclone structure for directing powder paint toward a surface which is to be painted. The cyclone structure includes a feed cylinder having an open outlet through which the powder paint is delivered toward the surface to be painted, this feed cylinder having an outlet which is spaced from the outlet and which is adapted to receive air and powder paint suspended therein. The air is given a whirling motion within the feed cylinder so that the powder paint suspended in the air is centrifugally advanced along the inner surface of the feed cylinder from the inlet toward the outlet thereof, a conduit communicating with the inlet to supply thereto air with powder paint suspended therein. An exhaust cylinder, whose diameter is smaller than the feed cylinder, communicates coaxially with the feed cylinder to discharge air from the interior thereof. An air supply communicates with the conduit while between the air supply and the inlet of the feed cylinder there is a powder paint supply from which powder paint is delivered to the conduit to be conveyed with the air flowing therethrough to the inlet of the feed cylinder. The part of the above conduit extending from the powder paint supply to the inlet of the feed cylinder and the feed cylinder itself provide for the air and powder a path of flow extending along the interior of the conduit from the powder paint supply through the inlet into the feed cylinder and along the feed cylinder through and somewhat beyond the outlet thereof. Situated along this path of flow is a corona discharge electrode structure for electrostatically charging the powder paint with unipolar ions so as to drive the charged powder paint electrostatically toward the surface which is to be painted.

52 Claims, 24 Drawing Figures

FIG. 1A
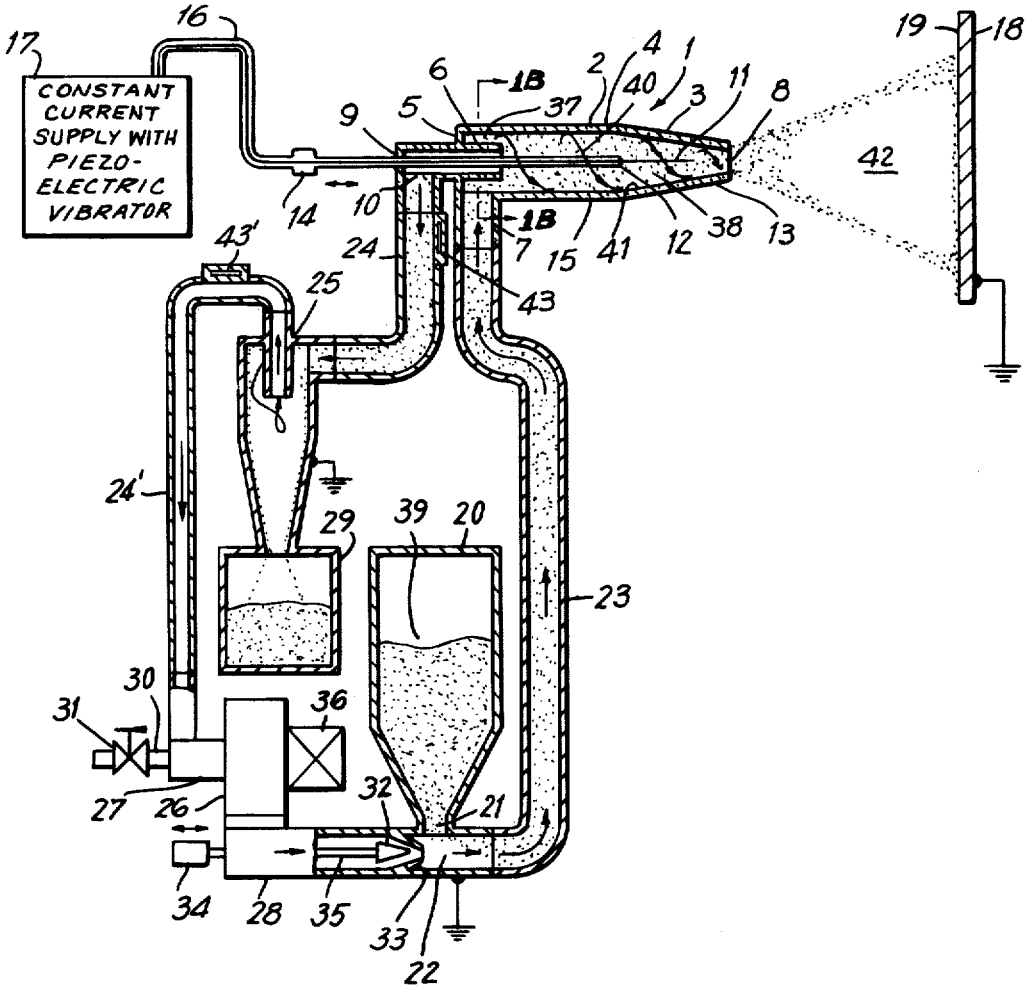
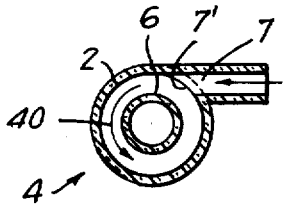
FIG. 1B

ELECTROSTATIC POWDER PAINTING APPARATUS

BACKGROUND OF THE INVENTION

The present invention relates to electrostatic powder painting apparatus.

As is well known, with such an apparatus it is possible to electrostatically charge paint in powder form so that it will become deposited on a surface which is to be painted.

With conventional electrostatic powder painting apparatus, the powder paint is supplied from a storage tank to be pneumatically conveyed to a powder gun provided with a corona discharge electrode having a high DC voltage applied thereto, so that the powder paint is charged by unipolar ions to be driven and deposited electrically onto the surface of an object which is to be painted and which is positioned in front of the powder gun. With conventional apparatus of this type there is a serious disadvantage in that the total amount of air, supplied by a compressor or blower for pneumatically conveying the powder, is discharged from the outlet of the powder gun together with the powder. This total amount of air which is discharged with the powder hinders the flow of the powder paint due to the electrostatic charging thereof and lowers the painting efficiency. If, in order to alleviate this drawback, it is attempted to decrease the amount of air, then the smooth pneumatic conveying of the powder paint is prevented, and the conveyed air pulsates undesirably so as to result in a non-uniform supply as well as non-uniform charging, thus unavoidably reducing the painting efficiency and the quality of the painting.

SUMMARY OF THE INVENTION

It is accordingly a primary object of the present invention to provide a powder painting apparatus which will avoid the above drawbacks encountered with conventional apparatus of this type.

In particular, it is an object of the present invention to provide an apparatus according to which it is possible to discharge toward the object to be painted less than the total amount of air which is supplied for conveying the powder paint while at the same time assuring smooth pneumatic conveying of the powder paint and maintaining the efficiency of the painting operation and a high quality in the coating applied to the object which is to be painted.

Thus, it is an object of the present invention to make it possible to utilize a relatively large amount of air for smoothly and uniformly conveying the powder paint to the powder gun, irrespective of the amount of powder paint which is supplied from a stroage tank, while at the same time assuring a smooth and uniform supply of the powder paint from the powder gun with a suifficient charging of the powder paint and an almost perfect delivery of the powder paint from the gun to the object to be painted.

Thus, it is an object of the present invention to provide a powder painting apparatus in which air discharged from the gun with the powder paint will not in any way interfere with the electrostatic delivery of the powder paint to the surface to be painted.

Moreover, it is an object of the present invention to provide an apparatus of the above type according to which it becomes possible to classify the particle size of the powder paint in such a way that powder paint composed only of relatively coarse particle size (greater than approximately 10 microns in diameter) is discharged from the apparatus toward the surface to be painted, particles of this relatively large size being remarkably effective for the purpose of powder painting. Thus, according to the objects of the present invention powder paint particles which are relatively fine and too small to be effective in powder painting are prevented from being discharged from the apparatus of the invention. Thus it is an object of the invention to provide a high degree of efficiency in the painting operation in this way.

It is furthermore an object of the present invention to provide an apparatus of the above type which while capable of separating the fine powder paint particles before they are driven toward the surface to be painted nevertheless can still make use of such fine particles.

It is also an object of the present invention to provide an apparatus of the above type which affords the possibility of achieving extremely fine and precise control of the air flow.

In addition, it is an object of the present invention to provide a construction of the above type which is capable of achieving the desired electrostatic charging of the particles with a construction which is extremely safe and which at the same time utilizes a relatively small amount of powder in a highly efficient manner.

Yet another object of the present invention is to provide an apparatus of the above type which can readily be adjusted in a highly convenient manner both with respect to the electrostatic charging as well as with respect to the control of air flow.

Furthermore it is an object of the present invention to provide an apparatus of the above type which is simple and robust while at the same time being relatively inexpensive and compact, and particularly convenient to operate.

According to the invention the electrostatic powder painting apparatus includes a cyclone means for directing powder paint toward a surface which is to be painted. This cyclone means includes a feed cylinder having an open outlet through which powder paint is adapted to be fed toward the surface which is to be painted. The feed cylinder has spaced from the above outlet thereof an inlet for receiving air and powder paint suspended therein. The cyclone means also includes a whirling means connected to the feed cylinder for providing for the air travelling along the interior thereof from the inlet toward the outlet a rotary whirling motion for feeding powder paint suspended in the air centrifugally along the inner surface of the feed cylinder from the inlet toward the outlet thereof. The cyclone means also includes an exhaust cylinder of a diameter smaller than the feed cylinder communicating coaxially with the interior of the feed cylinder so that air spaced from the inner surface of the feed cylinder can flow out of the interior thereof through this exhaust cylinder. A conduit means communicates with the inlet of the feed cylinder for conveying thereto air and powder paint suspended therein. An air supply means communicates with the conduit means distant from the inlet of the feed cylinder for supplying to the interior of the conduit means air to flow therethrough to the inlet and into the feed cylinder. A powder paint supply means communicates with the conduit means between the air supply means and the inlet of the feed cylinder for supplying to the interior of the conduit means powder paint to be suspended in air flowing along the interior thereof, so that in this way the portion of the conduit means extending from the powder paint supply means to the inlet of the feed cylinder and the feed cylinder itself provide for the powder paint a path of flow extending along the interior of the conduit means from the powder paint supply means to the inlet of the feed cylinder and from the latter inlet through the interior of the feed cylinder through and at least slightly beyond the outlet of the feed cylinder. A corona discharge electrode means is situated at the region of this latter path of flow for electrostatically charging the powder paint travelling along this path of flow with unipolar ions for driving the charged powder paint electrostatically toward the surface which is to be painted so as to become deposited thereon.

BRIEF DESCRIPTION OF DRAWINGS

The invention is illustrated by way of example in the accompanying drawings which form part of this application and in which:

FIG. 1A is a schematic partly sectional elevation of one possible embodiment of an apparatus according to the invention;

FIG. 1B is a fragmentary sectional elevation of part of the structure of FIG. 1A taken along line 1B—1B of FIG. 1A in the direction of the arrows and showing the manner in which a conduit means is connected to the inlet of a feed cylinder of a cyclone means by way of a structure which provides for whirling of the air in the feed cylinder;

DESCRIPTION OF PREFERRED EMBODIMENTS

Figure 2:
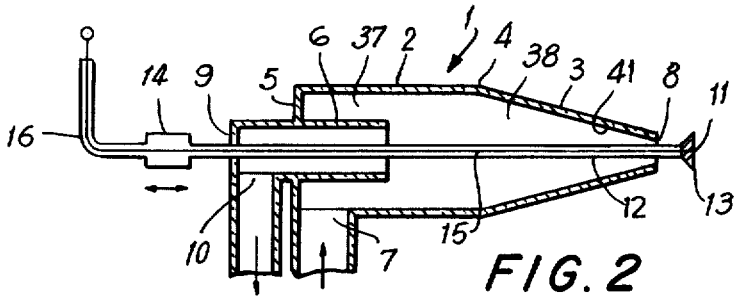
FIGS. 2–7 show the cyclone means of FIG. 1A provided respectively with different embodiments of a corona discharge means according to the invention.

Referring to FIG. 1A, there is illustrated therein one possible embodiment of an electrostatic powder painting apparatus according to the invention. Shown at the upper right of FIG. 1A is the powder gun of the apparatus of the invention, this powder gun 1 having the construction of a cyclone means. Thus, the illustrated cyclone means or powder gun 1 includes a feed cylinder 4 which is an outer casing and which has a rear cylindrical part 2 of constant diameter merging at its front end with a front tapered part 3 of frustoconical configuration, this feed cylinder 4 of the cyclone means 1 being made of an electrically non-conductive or insulating material such as a suitable glass or plastic material. The rear constant-diameter portion 2 of the feed cylinder 4 coaxially surrounds part of an exhaust cylinder 6 of the cyclone means 1. This exhaust cylinder 6 is of a diameter smaller than the feed cylinder 4 and has an inner portion extending into the interior of the portion 2 of the cylinder 4.

Thus, it will be seen that the exhaust cylinder 6 extends to the right beyond the end wall 5 of the feed cylinder 4 into the latter. This exhaust cylinder 6 also extends outwardly beyond the end wall 5 of the feed cylinder 4 and terminates itself in an end wall 9.

As is most clearly shown in FIGS. 1A and 1B, the rear portion 2 of the feed cylinder 4 is formed adjacent its end 5 with an inlet 7′ through which air with powder paint suspended therein is adapted to enter into the feed cylinder 4. This air with the powder paint suspended therein is delivered to the inlet 7′ by a conduit means 23 which has an end portion 7 connected tangentially to the feed cylinder 4, in the manner shown most clearly in FIG. 1B, so as to form a whirling means for providing for the air which enters the feed cylinder 4 a rotary whirling motion, thus causing in this way the powder particles to be centrifugally fed along the inner surface of the feed cylinder 4 from the inlet 7′ thereof toward the open outlet 8 of the feed cylinder 4, this open outlet 8 being situated at the right end of the portion 3 of the feed cylinder 4, as viewed in FIG. 1A. Thus, the outlet 8 forms the opening through which electrostatically charged powder paint is delivered from the gun.

The exhaust cylinder 6 communicates at its end distant from the feed cylinder 4 with a conduit means 10 through which relatively clean gas flows from the exhaust cylinder 6, this exhaust cylinder 6 of course having a right open end which receives air from the interior of the feed cylinder 4 at a location spaced inwardly from the inner surface thereof.

The powder painting apparatus further includes a charging means for electrostatically charging the powder paint. In the example of FIG. 1A, this charging means is a corona discharge means which includes a needle-like corona discharge electrode 11 extending along and coinciding with the central axis of the feed cylinder 4. At its left end, as viewed in FIG. 1A, the electrode 11 is carried by an elongated rod or cylinder 12 made of a suitable insulating material. This rod 12 extends with a snug sliding fit through an opening formed in the end wall 9 of the exhaust cylinder 6. In this way the rod 12 can be shifted along the common axis of the cylinders 4 and 6 so as to adjust the location of the electrode 11. Thus it is possible in this way to adjust the location of the tip 13 of the electrode 11. In order to render such adjustment convenient, the rod 12 carries at the exterior of the cylinder 6 a knob 14.

The electrode 11 is electrically connected with a conductor 15 which extends along the interior of the insulating rod 12, this conductor 15 being made of such a material that it can also constitute a current-limiting resistor of sufficiently high resistance. Beyond the knob 14 which is fixed to the rod 12, the conductor 15 extends through a flexible insulating cable 16, and the conductor 15 is connected to a source 17 which is a DC source of high voltage. This DC high voltage supply 17 may take a number of different forms. In the example illustrated in FIG. 1, however, it has a preferred form according to which the DC high voltage supply 17 is a constant current supply including a piezoelectric vibrator.

With this construction, there will be a DC corona discharge from the tip 13 of the electrode 11 through the outlet 8 toward a surface 19 of an object 18 which is to be painted, thus feeding in this way unipolar ion current toward the object 18. In this way, this part of the structure forms a charging means situated at the region of the path of flow of the air with the powder paint for electrostatically charging the powder paint travelling along this path of flow with unipolar ions so as to drive the charged powder paint electrostatically toward the surface 19 which is to be painted.

As has already been indicated above, a conduit means 23 is provided for conveying air with powder paint suspended therein toward the inlet 7' through the end portion 7 of the conduit means 23, this end portion 7 forming the whirling means as referred to above. The conduit means 23 receives the powder paint from a powder paint supply means 20. This powder paint supply means 20 is in the form of a suitable storage tank which is schematically illustrated in FIG. 1A. Access may be had to the interior 39 of the storage tank 20 in any suitable way. Thus, the top wall of the storage tank 20 may form a suitable cover which can be removed from time to time so that additional powder paint may be situated in the interior 39 of the supply means 20. The powder paint supply means 20 terminates at its lower end in an outlet 21 forming a supply port for delivering powder paint to the interior of the conduit means 23. The conduit means 23 includes a portion 22 which forms an injector section at which the powder paint is injected into the conduit means 23. In a manner described below air under pressure flows horizontally past the supply port 21 for drawing powder through the latter out of the interior 39 of the supply means 20, this powder then being suspended in the air flowing through the conduit means 23 to the inlet of the feed cylinder 4 to flow along the interior thereof through the outlet 8 in a manner described above. Thus it will be seen that the part of the conduit 23 extending from the supply port 21 to the feed cylinder 4 and the feed cylinder 4 itself define a path of flow for the air with the powder paint, and of course it is along this path of flow that the charging means is located for charging the powder paint. It is to be noted that this path of flow also includes the region just beyond the outlet 8 between the latter and the surface 19.

The pipe 10 which communicates with the exhaust cylinder 6 in turn forms an extension of a conduit 24 which in turn communicates through a cyclone separator 25, which forms a dust separator, which a further conduit 24', so that these conduits 24 and 24' form a return conduit means for providing a return flow path for the air exhausted from the interior of the feed cylinder 4 through the exhaust cylinder 6. The conduit 24' of the return conduit means communicates with a suction inlet 27 of a blower 26 which has an outlet 28 communicating with the injector section 22 of the conduit means 23, so that the unit 26–28 forms an air supply means communicating with the conduit means 23 for supplying air thereto.

The cyclone separator 25 is of a conventional construction and serves as a dust separator for separating from the air received from the condiut 24 any fine particles of dust which flow out of the feed cylinder 4 with the air exhausted through the exhaust cylinder 6. These fine dust particles are deposited in a collector 29 in the form of a suitable container schematically illustrated and having a construction according to which it is possible from time to time to remove the collected dust.

The inlet 27 of the air supply means is capable of receiving air not only from the conduit 24' but also from a branch pipe 30 which communicates with the outer atmosphere through a valve 31. Thus, the valve 31 is adjusted so as to admit through the pipe 30 to the air supply means an amount of air sufficient to compensate for the air discharged through the outlet 8. Thus, as is apparent from FIG. 1A, the illustrated embodiment provides a closed circuit for the air with the unit 30, 31 forming a structure for adding to the closed circuit makeup air to compensate for the air discharged at the outlet 8.

In order to control the air delivered by the air supply means 26–28 to the conduit means 23, a needle valve 32 is situated just in advance of an outlet nozzle 33 through which air enters the injector section 22. The valve 32 is carried by an elongated stem 35 which at its outer end carries a handle or knob 34, so that the operator can axially adjust the stem 35 for determining the position of the valve 32 with respect to the nozzle 33. In this way the pressure loss at the nozzle 33 can be adjusted so that it is possible to adjust the flow rate of the air which is circulated. The nozzle 33 of course forms an air jet which flows past the port 21 to provide the injector action at the injector section 22. Thus, this air jet will suck powder paint from the port 21 into the injector section 22 and this powder paint will be suspended in the air while being conveyed therewith through the conduit means 23 to the feed cylinder 4.

Thus, by providing air through the valve 31, this valve can be adjusted so that the air admitted therethrough will equal the amount of air discharged through the outlet 8 together with the powder paint.

The blower 26 of the air supply means is driven by the schematically illustrated motor 36. Preferably this motor is capable of having its speed adjusted so that by way of adjusting the speed of the motor 36, in addition to adjusting the valve 32, it is possible to control the flow rate of the air which circulates through the apparatus, thus making it possible in this way to control the velocity with which the powder paint is conveyed. Of course, the construction of the cyclone separator 25 is such that it is capable of separating from the air received from the conduit 24 particles of the size far smaller than the size of the particles separated from the air by the cyclone action in the cyclone means 1 which forms the powder gun.

During operation of the air supply means 26–28, the air flows from the outlet 28 through the nozzle 33 into the injector section 22 and then along the conduit 23 into the cyclone means 1. Upon entering the cyclone means 1 the air whirls around the inner portion of the exhaust cylinder 6 in the gap 37 defined between the latter and the portion 2 of the feed cylinder 4. Then the air flows from this space or gap 37 along the interior 38 of the feed cylinder 4, in front of the exhaust cylinder 6, air then entering into the exhaust cylinder 6 to reach the pipe 10 through which the air received in the exhaust cylinder 6 flows to the conduit 24 of the return conduit means. This air then flows through the cyclone separator 25 where fine particles of dust are separated from the air, and the thus-cleaned air is delivered to the conduit 24' of the return conduit means. From the conduit 24' the air flows into the suction port 27 of the blower 26, and of course from the blower 26 the air flows to the outlet 28 of the blower 26. The powder paint which is stored in the supply means 20 flows from the interior 39 thereof through the supply port 21 into the injector section 22, being sucked by the jet issuing from the nozzle 33, and thus this powder paint which flows from the port 21 into the injector section 22 is pneumatically fed along the conduit means 23 to the inlet of the cyclone means 1. Upon entering the cyclone means 1 the air conveying the powder paint whirls in the clearance space 37 between the exhaust cylinder 6 and the feed cylinder 4, this air entering tangentially, as indicated in FIG. 1B, so that a strong spiralling or whirling motion in the direction of the arrow 40 is given to the air in the space 37 as well as in the space 38. As a result, the relatively coarse particles which are separated by the cyclone means 1 from the air as a result of the centrifugal action travel along a spiral path along the inner surface 41 of the feed cylinder 4, reaching in this way the outlet 8 where in a conventional cyclone the separated solid particles would be collected and where instead with the structure of the invention the powder paint is released to be supplied to the space 42 in front of the surface 19 of the object 18 which is to be painted. In this case, the particles are subjected to bombardment of unipolar ions supplied from the tip 13 which provides the DC corona discharge of the corona discharge electrode 11, and thus the powder paint particles are strongly charged to be driven toward the right, as viewed in FIG. 1A, by the DC field formed between the tip 13 and the surface 19 of the grounded object 18 which is to be painted, the particles of powder paint thus being deposited on this surface 19.

On the other hand, the spiralling air current from which the relatively coarse particles of powder paint have been separated is sucked into the interior of the exhaust cylinder 6 together with any slight amount of fine particles of powder paint which have not been separated by the cyclone means 1, and this air entering the exhaust cylinder 6 reaches the cyclone separator 25 where fine particles are separated so as to be prevented from flowing with the air through the return conduit 24'. These fine particles are of course collected in the box 29, and completely cleaned air is fed through the return conduit 24' to the suction port 27 of the blower 26 to be discharged out of the outlet 28 thereof and again fed forcibly from the nozzle 33 into the injector section 22.

It is thus apparent that with the above construction while a relatively large amount of air is continuously circulated in the closed circuit itself, so as to smoothly convey the powder paint supply from the port 21 to the cyclone means 1, irrespective of the particular amount of powder paint which is conveyed, practically only powder paint alone issues from the outlet 8 toward the space 42, so that in this way with the structure of the invention it is possible to prevent the air itself from hindering the action of the electrostatic paint deposition, such action being hindered with conventional structures as a result of the air current jet which issues with the powder paint. At the same time, inasmuch as the powder paint moves in a spiral path to the right, as viewed in FIG. 1A, in the form of a uniform film along the inner surface 41 of the feed cylinder 4, it is possible for the particles of powder paint in this uniform film to be charged evenly and strongly by the unipolar ions supplied from the tip 13 of the corona discharge electrode 11. In addition, of the powder paint which is received from the supply means 20, only relatively coarse particles capable of providing a coating of high quality are supplied to the right from the outlet 8.

All of the above features enable the apparatus of the invention to achieve a remarkably high painting efficiency and a remarkably high quality in the coating of paint, these latter results being produced by the effects of the actions which are peculiar to the above-described structure of the invention. With the embodiment of FIG. 1A, the fine particles of powder paint are not released to the atmosphere and are completely separated by the high-performance cyclone separator 25 so as to be collected in the receiving container 29. As a result these fine particles of powder paint can be effectively used for any other purpose. In addition, since the circulation path for the air forms a completely closed circuit, those extra fine particles which possibly may not be separated by the cyclone separator 25 are not released to the outer atmosphere so as to provide a perfect prevention of pollution of the outer atmosphere. Instead, such extra fine particles are condensed to fuse with each other and to form somewhat coarser particles during circulation several times through the closed circuit, and upon increasing in size in this way, these particles are eventually separated at the cyclone separator 25. With the above construction by opening the valve 31 only slightly, so as to introduce a slight amount of air from the outer atmosphere into the suction port 27 through the branch pipe 30, it is possible to introduce into the closed circuit an amount of air which equals that which leaks into the space 42 through the outlet 8. Actually, the amount of air which leaks out through the outlet 8 into the space 42 can be adjusted by adjusting the opening of the valve 31. In this way it is possible to achieve a smooth spiralling movement of the coarse particles of powder paint along the inner surface 41 of the feed cylinder 4 toward the right, as viewed in FIG. 1A, until these particles are discharged through the outlet 8 into the space 42.

The opening provided at the nozzle 33 by way of the valve 32 and the speed selected for the motor 36 for driving the blower 26 can be changed, either separately or together, so as to control in this way the amount of air used for conveying the powder paint, thus maintaining this amount of air at an optimum value in accordance with the quantity of powder which is supplied, these adjustments also being effective to control the particle size of the powder paint which is separated in the cyclone means 1 to some extent.

The above-described structure shown in FIG. 1A includes the deionizing means 43 and 43' which are schematically illustrated and which are in the form of appropriate deionizers with radio isotope, or AC corona discharge, or the like applied, this deionizing means serving to prevent the electrostatic adhesion of fine particles onto the inner surfaces of the pipes 24 and 24' of the return conduit means as well as at the inner surface of the cyclone separator 25 and the blower 26, etc.

FIGS. 2-6 respectively illustrate different embodiments of corona discharge means capable of being used with the cyclone means 1 of the invention. Thus, with respect to the cyclone means 1, FIGS. 2-6 have the same reference characters as those used in FIG. 1A.

Referring now to FIG. 2, in this embodiment the corona discharge means includes a corona discharge electrode 11 situated in front of the outlet 8. This electrode 11 has the configuration of a cone the larger end of which is more distant from the outlet end than the smaller vertex end. At the larger base end of the conical electrode 11, this electrode is provided with a circumferential sharp edge 13 formed as a corona generator. Thus with this particular construction, the cone-shaped electrode will act in a purely mechanical manner to disperse the powder paint while at the same time charging the latter. Thus, the powder paint issuing from the outlet 11 collides with the conical conductor 11 to be mechanically dispersed and at the same time strongly charged by the DC corona discharge generated from the sharp edge 13, to form a uniform layer on the surface which is to be painted, thus improving the quality of the painting. In this embodiment the conical corona discharge electrode is made of an insulating material, and the surface thereof, except the sharp edge 13, is coated with a sufficiently high resistance covering to assure safety. It will be noted from FIG. 2, that the corona discharge electrode 11 is connected in a manner described above in connection with FIG. 1A through a conductor 15 to the power source and is also supported by the rod 12 as described above.

Figure 3:
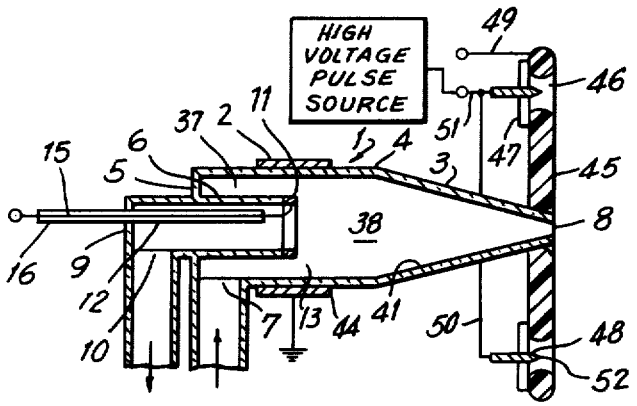

Referring to FIG. 3, the corona discharge eletrode 11 takes the form of a ring carried by the inner end of the exhaust cylinder 6, extending along the inner end of the cylinder 6 so as to have an annular configuration. In this case also the ring 11 is composed of an insulating material while the edge 13 thereof is sharp so as to have the configuration of a circular knife edge, so as to form a corona discharge section. A part of the portion 2 of the feed cylinder 4 of FIG. 3 forms a tubular wall portion surrounding the discharge electrode 11 and carrying an electrode 44 which is thus opposed to the electrode 11, this electrode 44 being made of an insulating material and being grounded, while surrounding and engaging the portion 2 of the feed cylinder 4. Thus, in this embodiment the part of the flow path formed by the space 37 between the exhaust cylinder 6 and the feed cylinder 4 forms the location where the powder paint is charged in a unipolar manner during movement through the space 37 to the space 38 in front of the exhaust cylinder 6.

The embodiment of FIG. 3 includes a third electrode 45 which is in the form of a circular plate or disc carried by the feed cylinder 4 and surrounding the outlet 8 thereof in the manner illustrated in FIG. 3. This third electrode 45 forms a DC field and is composed of an insulating material while having a resistance sufficient for safety. Thus this third electrode 45 is directly carried by the conical portion 3 of the feed cylinder 4. The third electrode 45 is formed with a plurality of openings 46 distributed along the circumferential region of the disc 45. At the centers of the several openings 46 there are respectively arranged a plurality of needle-like corona discharge electrodes 48 for producing a pulse charging effect, these electrodes 48 being carried by insulator supports 47 which in turn are mounted on the disc 45. This third electrode 45 is connected through a conductor 49, having a sufficiently high current-limiting resistance valve for safety purposes, to a DC power source, having the same polarity as the power source 17, but different from the power source 17 and not illustrated in FIG. 3. Thus, in this way the electrode 45 will form a DC field to drive the charged powder paint into the space 42.

The several corona discharge electrodes 48 are respectively connected electrically to a common conductor 50 also having a sufficiently high current-limiting resistance value for safety purposes. In addition, these electrodes 48 are electrically connected with current-limiting resistances 51, for safety purposes, these resistances 51, of which only one is illustrated in FIG. 3, having sufficiently high resistance values to achieve the desired safety and being respectively provided for the several corona discharge electrodes 48. In addition, as is schematically shown for one of the electrodes 48 in FIG. 2, the several electrodes 48 are electrically connected to a high-tension pulse supply, so that at the tips 52 of the several electrodes 48 the latter provide a pulse-type of corona discharge with the same plurality as that provided by way of the power source 17 shown in FIG. 1A. Thus, the electrodes 48 discharge at their tips 52 pulse-ion current of the same polarity as that of the discharge electrode 11, this supply of pulse ion current being provided through the space 42 onto the surface 19 of the object 18 to be painted. Thus the layer of powder paint is forcefully deposited onto the surface 19 without any possibility of reverse ionization, so as to further improve the quality of the painting.

Instead of a pulsating voltage electrically connected to the electrodes 48, it is possible to use AC voltage. In this latter case, a corona current proportional to the peak voltage is supplied at every half cycle of alternating current, and therefore the corona current can be controlled by controlling the peak voltage and frequency of the alternating current.

Figure 4:
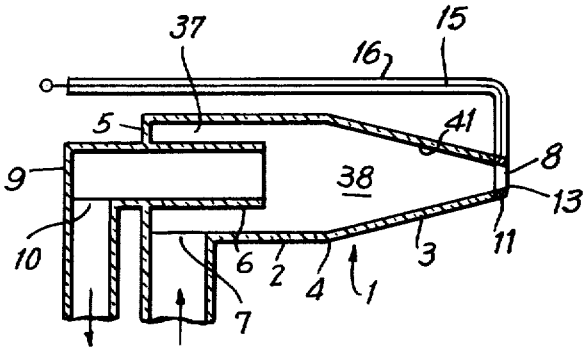

According to the embodiment of the invention which is illustrated in FIG. 4, the corona discharge electrode 11 in the form of a ring is situated at and extends along the outlet 8 of the feed cylinder 4. Of course, this feed cylinder 4 is composed of an insulating material. A DC corona discharge is provided at the sharp edge 13 of the annular electrode 11. This discharge from the right circular edge 13 of electrode 11, as viewed in FIG. 4, is directed toward the object 18 which is to be painted, so as to forcefully and instantaneously charge the powder paint issuing to the right through the outlet 8, as viewed in FIG. 4, thus in this way simultaneously electrically driving the powder paint to the right, as viewed in FIG. 4, toward the object to be painted.

In the embodiment of FIG. 4, the discharge electrode 11 is composed of an insulating material having a high-resistance covering, or it may take the form of a fine wire ring with a small effective capacity. The conductor 15 is electrically connected to the electrode 11 and forms a current-limiting resistor with sufficiently high resistance, thus assuring the desired safety. In the embodiments of FIGS. 2–4 the conductor 15 of course is insulated by the cable 16 and is connected to the source 17 as described above in connection with FIG. 1A.

Figure 5:
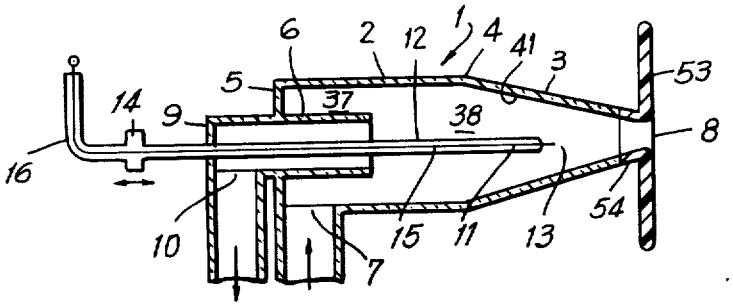

The embodiment of FIG. 5 differs from that of FIG. 1A only in that this embodiment of FIG. 5 includes an auxiliary electrode 53 of disc-shaped configuration which forms an electrical field and which has at its surface a covering of sufficiently high safety-resistance, the disc 53 being formed of an insulating material and being concentric with the outlet 8. It will be seen from FIG. 5 that in fact the auxiliary electrode 53 has at its central opening, which forms an extension of the outlet 8, a tapered portion 54 of tubular configuration, this portion 54 of the electrode 53 forming the extension of the outlet of the feed cylinder 4. This portion 54 is capable of absorbing unipolar ions supplied from the tip of the corona discharge electrode 11 and is charged at a high potential with the same polarity as that of the corona discharge electrode and the powder paint. This embodiment of FIG. 5 forms a fairly uniform field in the space in front of the object 18 which is to be painted, so as to control the painting pattern of the powder paint.

Figure 6:
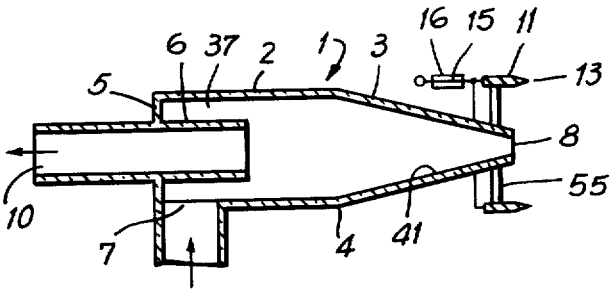

In the embodiment of FIG. 6, a plurality of corona discharge electrodes 11 are situated concentrically around the outlet 8 of the feed cylinder 4 at the exterior of the latter, these electrodes 11 being supported by suitable brackets or braces 55 which are directly carried by the feed cylinder 4 at the region of the outlet 8. Thus, the several electrodes 11 are parallel to the axis of the cylinder 4 while being distributed about this axis. The powder paint which issues from the outlet 8 is charged in the space 42 by way of unipolar ion current issuing from the tips 13 of the corona discharge electrodes 11 toward the object 18 which is to be painted, the powder paint being driven to the right, as viewed in FIG. 6, by the electrical field so as to become deposited on the surface 19. The conductor 15 is connected to the several electrodes 11 and has a sufficiently high current-limiting resistance value for safety purposes, this conductor 15 again being connected through the insulating cable 16 with the source of high voltage which supplies the power to the discharge electrodes 11.

Figure 7:
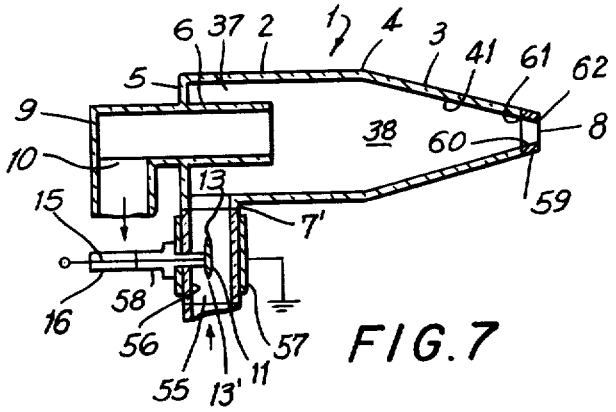

Referring now to FIG. 7, in this embodiment the corona discharge electrode 11 is situated at that part of the path of flow of the air and powder which is located at the end region 55 of the conduit means 23 in the embodiment of FIG. 7, this end region 55 forming the whirling means which communicates tangentially with the inlet 7' of the feed cylinder 4, as described above. This portion 55 of the structure includes the tubular member 56 made of an insulating material having some conductivity, such as, for example, a suitable layer of glass. The electrode 11 extends along the axis of the tubular wall portion 56 and is surrounded by an outer tubular electrode 57 which is grounded and carried by the tubular wall portion 56 at the exterior thereof. The corona discharge electrode 11 has a needle-like configuration and is carried by a porcelain tube 58 which extends through aligned openings of the electrode 57 and the tubular wall portion 56 in the manner indicated in FIG. 7. Unipolar corona discharge is provided from the tips 13 and 13' of the electrode 11 toward the inner surface of the tubular wall 56 so as to strongly charge the particles of powder paint travelling through the interior of the tubular wall portion 56. The glass construction of the tubular wall portion 56 prevents generation of spark discharge or reverse ionization discharge from the corona discharge electrode 11 to the opposed electrode 57. In addition, inasmuch as the wall of tubular portion 56 has an appropriate conductivity, it leaks charges stored at the surface, and in this way provides a continuously stable corona discharge. It will be seen that the electrode 11 is connected electrically to the conductor 15 which extends through the porcelain support 58 as well as through the flexible cable 16 to be connected with the source 17 as described above.

The embodiment of FIG. 7 includes an auxiliary electrode 59 in the form of a ring extending along the outlet 8 of the feed cylinder 4. This ring 59 is made of an insulating material and is maintained at a high potential having the same polarity as that of the particles of powder paint since the strongly charged particles of powder paint come into contact with the inner surface 60 of the auxiliary electrode 59 while at the same time this effect also is achieved as a result of the corona discharge from the rear edge 61 of the electrode 59 toward the strongly charged particles. Thus, the DC field to drive the particles released from the outlet 8 toward the object to be painted is formed in the space 42. It is also possible to provide the electrode 59 with a front sharp circular edge 62 having the configuration of a circular knife edge, so as to provide DC corona discharge with the same polarity as that of the particles toward the object which is to be painted, thus providing a painting layer which strongly adheres to the surface to be painted, by supplying corona current to improve the adhesion.

Figure 8:
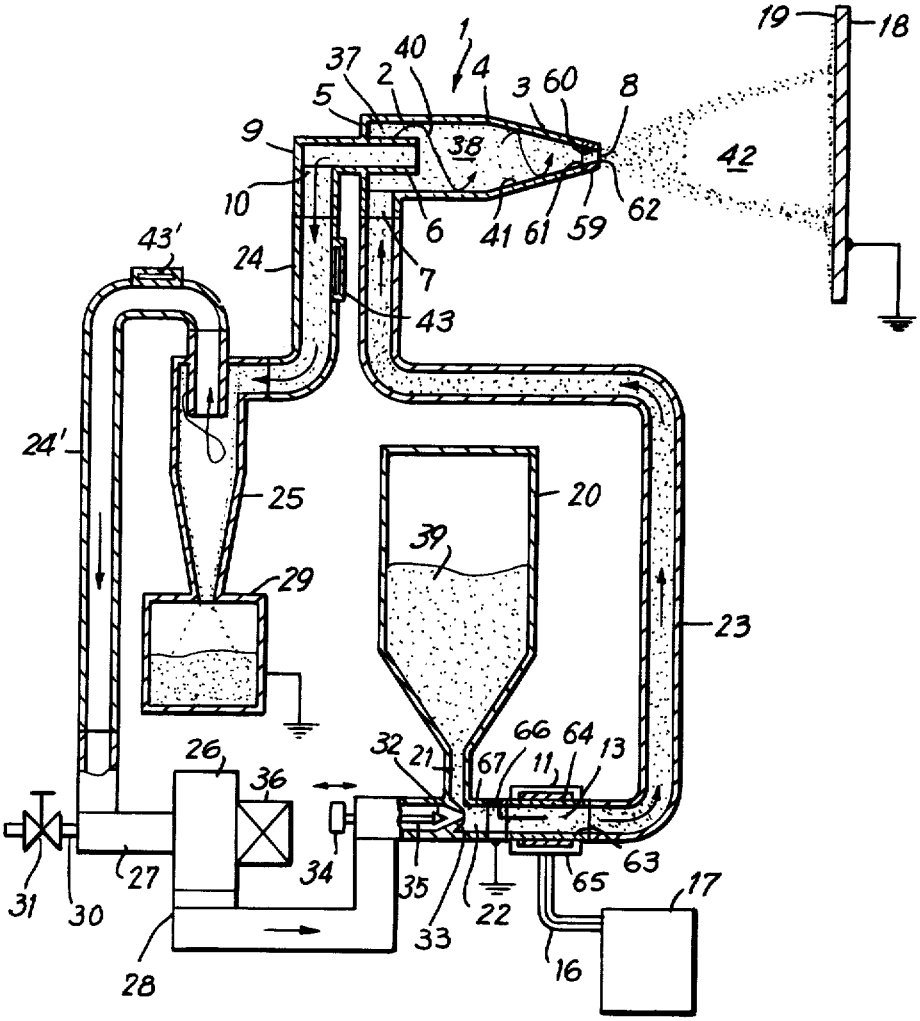
FIG. 8 is a schematic partly sectional elevation of an apparatus similar to that of FIG. 1A but having a different corona discharge means.

Referring now to FIG. 8, the embodiment of the invention illustrated therein is of course primarily the same as that of FIG. 1A. However, in this embodiment the corona discharge electrode 11 is situated at the part of the path of flow of the air and powder paint which is situated in the immediate vicinity of the injector section 22. In this embodiment the discharge electrode 11 is situated immediately in front of the injector section. The conduit means 23 includes immediately in front of the injector section 22 a tubular wall portion 63 composed of a layer of glass material as described above in connection with FIG. 7. This tubular wall portion 63 has the same function as the tubular wall portion 56 of FIG. 7. At its exterior the tubular wall portion 63 carries an outer tubular electrode 64 which opposes the electrode 11, and in this embodiment it is the electrode 64 which is connected to the power source 17 by way of the conductor 15 carried by the cable 16. Thus this electrode 64 is connected to the DC high voltage supply 17. The outer surface of the electrode 64 is covered by an insulating material 65.

Between the injector section 22 and the tubular wall portion 63, the conduit means 23 of FIG. 8 includes a circular or tubular wall portion 66 which is electrically conductive, thus forming a short conductive cylinder 66, and this cylinder is grounded, as illustrated. The corona discharge electrode 11 which has the configuration of a needle extends along the common axis of the cylinder 66 and the tubular wall portion 63, this electrode 11 being carried at its left end, as viewed in FIG. 8, by the inner end of a radial pin or brace 67 which is electrically conductive and which is fixed to the cylinder 66 projecting radially inwardly from the inner surface thereof. Thus, the inner end of the support member 67, which is electrically conductive, is connected with and supports the electrode 11. Distant from the support 67 the electrode 11 has the tip 13 from which there is a DC corona discharge toward the tubular wall portion 63, for strongly charging the powder paint travelling along this portion of the path of flow. The thus-charged particles of powder paint will now continue to travel through the remainder of the conduit means 23, which is of course composed of insulating material, so as to enter through the inlet of the feed cylinder 4 into the interior of the latter, the cyclone means 1 which includes the feed cylinder 4 and the exhaust cylinder 6 of course also being made of an insulating material. The actions occurring subsequent to entry of the air and powder paint into the feed cylinder 4 are the same as those of FIG. 7. Also, the structure for returning the air from the exhaust cylinder 6 back to the air supply means as well as the structure for supplying the powder paint are the same in FIG. 8 as in FIG. 7 and FIG. 1, and the same reference characters are used with further description being unnecessary.

It is to be noted that certain advantages are present with the embodiment of FIG. 8 as compared to those of FIGS. 1 and 7. Thus with the embodiment of FIG. 8 it is unnecessary to connect the DC high voltage wiring to the cyclone means 1 or to the structure in the immediate vicinity thereof. Thus with FIG. 8 in the event that the cyclone means 1 is made of an electrically conductive material, the entire cyclone means 1, including the cylinders 4 and 6, for example, can be held at a high potential and the electrical field for driving charged powder to the object 18 to be painted is formed in the space 42. Thus, with such a construction the auxiliary electrode 59 of FIG. 8 also will provide at the circumferential edge of the auxiliary electrode the corona discharge with the same polarity as that of the charged powder so as to provide the effect of adding to the adhesive force of the powder paint.

It is also to be noted, in connection with the embodiments of FIGS. 7 and 8, that it is possible to provide an arrangement according to which the corona discharge electrode is situated at the inner surface of a part of the conduit means 23 which is made of an insulating material. The opposite electrode which cooperates with the corona discharge electrode can be composed of a resistor having a sufficiently high resistance or coated with a sufficiently high resistance covering, with this opposite electrode being situated along the axis of the conduit means 23. The corona discharge electrode is grounded while the opposed electrode at the axis of the conduit means 23 is connected to a high-tension supply through a sufficiently high current-limiting resistance for safety purposes. Thus, with such a construction there will be corona discharge from the inner surface of the conduit wall toward the axial center of the conduit means so as to charge the powder paint in this way. With such a construction the corona discharge electrode at the inner surface of the conduit means can take the form of a metallic wire, a metallic foil, a needle, or a foil conductor coated with a conductive paint, etc. Also, in this case it is preferable to provide guide vanes or a tangential feeding of the flowing powder to achieve for the flowing powder a whirling motion in the space where charging takes place, so as to cause strong spiralling motion in the charging section. The powder paint will as a result become separated from the air and by centrifugal force will engage the inner surface of the pipe wall to glide and progress along the corona discharge electrode with the electrical field being highly concentrated to achieve a strong charging of the powder paint particles with such a construction. A structure of this type is described below in connection with FIG. 12 where conductors are arranged along the inner surface of the feed cylinder 4.

Figure 9:
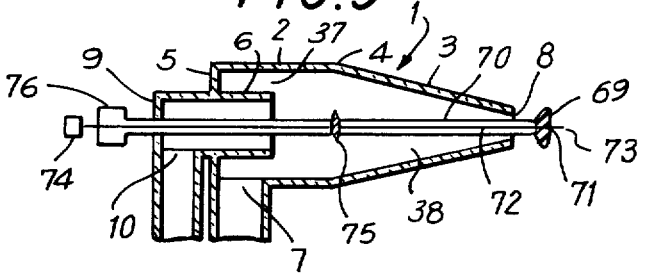
FIGS. 9–11 respectively illustate further embodiments of corona discharge means to be utilized with an apparatus as shown in FIG. 8.
Figure 10:
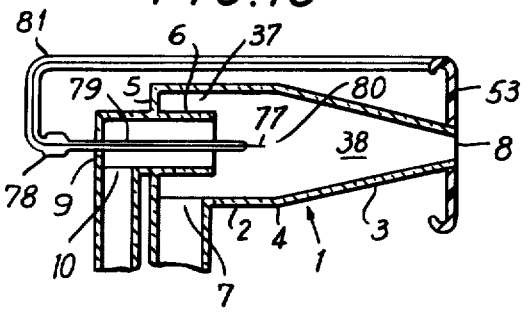
Figure 11:
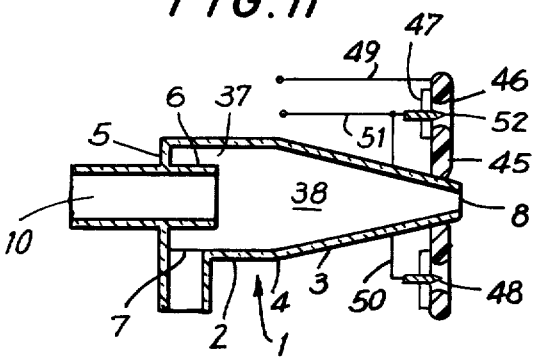

Moreover, with a construction of this type where the discharge electrode is situated at the inner surface of a part of the conduit means 23 with the opposed cooperating electrode situated at the axis of the conduit means 23, it is possible to eliminate the corona discharge electrode 11 and elements 63–67. Instead it is possible to use the charging created by friction inside the conduit means 23 as well as inside the cyclone means 1 in order to charge the powder paint. For such a purpose the feed cylinder 4 can be provided at its cylindrical portion 2 as a conductor which is grounded while the conical section 3 will be made of an insulating material, and the auxiliary electrode 59 in the form of a ring will form at the outlet a field and will provide a corona discharge at the outlet 8. FIGS. 9–11 show different embodiments capable of being used with the structure of FIG. 8. In FIGS. 9–11 the various parts and reference characters correspond to those of FIG. 8 except for the differences pointed out below.

Referring now to FIG. 9, in this embodiment there is a conical auxiliary electrode 69 made of a material of sufficiently high resistance for safety purposes. This auxiliary electrode 69 is situated in front of the outlet 8 to be mechanically engaged by the issuing powder paint so as to disperse the powder paint, while the auxiliary electrode 69 also serves to form the field, instead of the auxiliary electrode 59 of FIG. 8. The electrode 69 is carried by an elongated rod 70 of insulating material supported with a snug sliding fit in an opening of the end wall 9 of the exhaust cylinder 6 so as to be capable of shifting axially along the axis of the feed cylinder 4, this latter axis coinciding with the axis of the rod 70. Thus, the insulating cylinder or rod 70 carries the electrode 69. It will be noted that the electrode 69 of conical configuration is fixed at its vertex end to the rod 70 while the larger base end of the electrode 69 is situated more distant from the outlet 8.

At its center the electrode 69 is formed with an axial opening 71. A corona discharge electrode 72 extends through this axial opening 71 as well as through an axial bore formed in the rod 70. Thus, the auxiliary corona discharge electrode 72 is arranged so as to be capable of sliding freely with respect to the rod 70 and the auxiliary electrode 69. The auxiliary corona discharge electrode 72 terminates at its right end, as viewed in FIG. 9, in a tip 73 which is situated to the right of and beyond the auxiliary electrode 69. The left end of the corona discharge electrode 72 carries a knob 74 which can be engaged by the operator for the purpose of shifting the electrode 72 so as to determine in this way the distance of the tip 73 beyond the electrode 69. The insulating cylinder or rod 70 carries a plurality of corona discharge electrodes 75 in the form of needles which extend radially with respect to the corona discharge electrode 72 outwardly from the latter through the wall of the rod 70 to the exterior thereof as illustrated in FIG. 9. These corona discharge electrodes 75 are similar to needles and have their inner ends in contact with the axially shiftable auxiliary corona discharge electrodes 72, the discharge electrodes 75 providing for current collection and being distributed circumferentially about the auxiliary electrode 72 while extending radially therefrom and being at right angles thereto. At its end region which projects to the left beyond the end wall 9 of the exhaust cylinder 6, the insulating rod 72 carries a knob 76 which is accessible to the operator so that the rod 72 and all of the structure carried thereby can be moved along the axis of the feed cylinder 4. In this way the distance of the electrode 69 in front of the outlet 8 can be adjusted thus permitting the operator to change freely the powder dispersal pattern.

The strongly charged powder paint, charged in the manner shown in FIG. 8 just beyond the injector section 22, enters with the embodiment of FIG. 9 through the inlet of the feed cylinder 4 into the interior thereof and is separated as a result of the centrifugal force resulting from the whirling or spiralling motion, so that the coarse particles of powder paint move along the inner surface of the feed cylinder 4 to discharge to the right, as viewed in FIG. 9, out through the outlet 8. During this part of the operation corona discharge is provided from the corona discharge electrodes 75 in the form of needles which are provided for current collection, this corona discharge taking place toward the charged particles of powder paint in the powder gun, and the charges are partially collected by the auxiliary electrode 69 and the auxiliary corona discharge electrode 72. Thus, both of these electrodes 69 and 72 are maintained at a high potential with the same polarity as that of the charged powder paint, the latter being directed against the grounded object 18 which is to be painted. The auxiliary electrode 69 forms the field for driving the particles through the space 42 while the auxiliary corona discharge electrode 72 provides DC corona discharge from its tip 73 toward the object 18 which is to be painted, supplying ion current for making the powder paint adhere to the surface to be painted. With this construction the powder paint issuing from the outlet 8 collides with the conical auxiliary electrode 69 to be mechanically dispersed thereby, thus increasing the spread and the uniformity of the painting. By increasing the distance of the tip 73 of auxiliary corona discharge electrode 72 from the auxiliary electrode 69, the ion current increases, whereas if this distance is decreased the ion current decreases. Therefore, the value or magnitude of the ion current can be set at the best possible intensity for painting by adjustment of the knob 74.

Referring now to FIG. 10, there is illustrated therein an auxiliary electrode 53 in the form of a disc made of a sufficiently high resistance material for safety purposes and provided for forming the field. This auxiliary electrode 53 is situated at and surrounds the outlet 8 of the cyclone means 1 which is made of an insulating material. The function of the auxiliary electrode 53 is the same as that of the disc 53 shown in FIG. 5. However, in the embodiment of FIG. 10 the high potential for forming the field is provided by partially collecting the charges of the charged powder, as mentioned above, inside the powder gun or cyclone means 1, by way of the needle-like corona discharge electrode 77 which is provided for current collection. This needle-like corona discharge electrode 77 is carried by an insulating rod or cylinder 79 having a knob 78. The rod 79 also has a snug sliding fit through an opening in the end 9 of the exhaust cylinder 6, so that by way of the knob 78 it is possible to adjust the position of the electrode 77. Thus, the electrode 77 together with the rod 79 carrying the same extend along the axis of the cylinder 6 and of course along the axis of the cylinder 4, with the exposed part of the electrode 77 extending into the space 38. The corona discharge is provided from the tip 80 of the electrode 77 toward the charged powder for collection of charges which are delivered through the cable 81, by way of a conductor situated therein, to the auxiliary electrode 53 in the manner shown in FIG. 10. Of course this conductor in the cable 81 is electrically connected with the electrode 77. By moving the knob 78 it is possible to change the position of the tip 80 along the axis of the feed cylinder 4, so as to adjust in this way the amount of collected charges, thus adjusting the potential of the auxiliary electrode 53. Of course with the embodiment of FIG. 10, the powder paint reaching the feed cylinder 4 is charged by way of the structure shown at the lower part of FIG. 8 and described above.

Referring now to FIG. 11, there is illustrated therein an electrode system for pulse charging as described above in connection with FIG. 3. Thus, it will be seen that the embodiment of FIG. 11 has situated at the region surrounding the outlet 8 a structure as described above and shown in FIG. 3 at the same region. However, with the embodiment of FIG. 11, where the cyclone means 1 is made of an insulating material, this electrode system which is the same as that of FIG. 3 replaces the auxiliary electrode 59 of FIG. 8. In this way the system of FIG. 11 forms a field for driving the powder paint in the space 42 and supplies ion current for making the layer of powder paint adhere to the surface 19. The reference characters 45–52 in FIG. 11 indicate the same elements as in FIG. 3, these elements having the same functions as in in FIG. 3 with the same results, so that further explanation is not required.

Of course, all of the powder guns shown in FIGS. 9–11 can be used also with a construction where the powder paint is charged by friction only, without the corona discharge electrode 11 for charging the powder paint and the elements 63–67 in FIG. 8.

Figure 12:
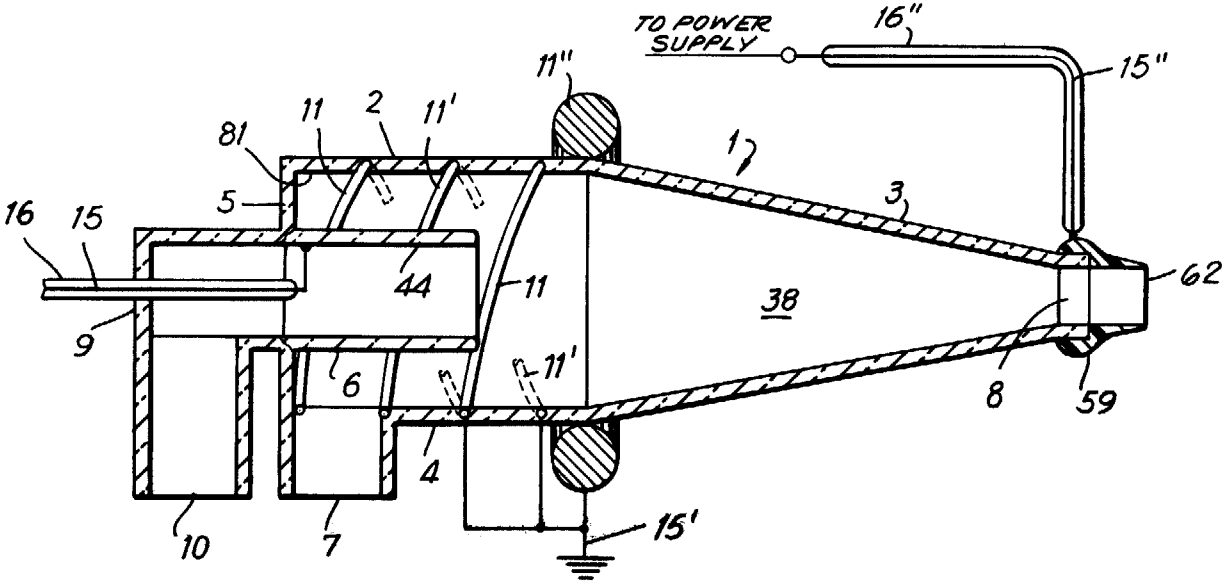
FIG. 12 is a schematic partly sectional elevation fragmentarily illustrating a still further embodiment of a corona discharge means of the invention to be utilized with a cyclone means of the invention.

Referring now to FIG. 12, in this embodiment the corona discharge electrode is situated at the inner surface of the portion 2 of the feed cylinder 4 of the cylone means 1, this portion 2 being formed of insulating material. The various components of FIG. 12 which have the same reference characters as the corresponding components of FIGS. 1A–11 serve the same purpose and have the same functions. In FIG. 12 the corona discharge electrodes 11 and 11' are in the form of two fine wires arranged in a spiral along the inner surface of the portion 2 of the feed cylinder 4, so as to coincide with the spiral path along which the air or outer gas travels when flowing through the inlet into the feed cylinder 4. These electrodes 11 and 11' are grounded by way of a conductor 15'. A corona discharge is provided from these electrodes 11 and 11' toward the opposed electrode 44 which forms part of the exhaust cylinder 6 in this embodiment and which is composed of a high resistance material electrically connected to the source of high tension through the conductor 15 of sufficiently high current-limiting resistance for safety purposes and carried by the cable 16 as illustrated. At the outlet 8 in FIG. 12 there is the tubular or cylindrical corona discharge electrode 59 made of an insulating material coated with a high resistance covering and having a sharp circular front edge 62, this electrode 59 of course being concentric with the outlet 8 through which the powder paint issues from the cyclone means 1. This electrode 59 is connected through the cable 16'', and in particular through the conductor 15'' therein, having a sufficiently high current-limiting resistance for safety purposes, to another high-tension supply which is not illustrated and which has the same polarity as but a higher voltage than the above-mentioned high-tension supply connected to the electrode formed by the cylinder 44. Thus, corona discharge having the same polarity as that of the corona discharge electrodes 11 and 11'' is provided at the edge 62 toward the grounded object 18 which is to be painted.

Surrounding the feed cylinder 4 at the junction between the portions 2 and 3 thereof is a ring electrode 11'' for protection purposes, this electrode 11'' being grounded through the conductor 15'. The ring electrode 11'' prevents the generation of corona discharge between the electrodes 11 and 11', on the one hand, and the electrode 59, on the other hand, while at the same time absorbing current leaking from the electrode 59 so as to maintain the outer wall potential of the cylinder portion 2 aways at ground potential, for the safety of individuals who may happen to come into contact with this portion of the structure. The particles of powder paint which enter through the inlet into the feed cylinder 4 together with the gas or other air advance toward the right, as viewed in FIG. 12, flowing in a spiral path along the inner surface 81 of the feed cylinder 4, so as to glide along the corona discharge electrodes 11 and 11', thus engaging the concentrated field at these electrodes and being subjected to bombardment of ions under the effect of this remarkably high field, so as to become very strongly charged. These particles then continue to flow along the spiral path and proceed further toward the right, as viewed in FIG. 12, along the inner surface of the conical section 3, coming into contact with the circular sharp edge 62 of the corona discharge electrode 59 beyond which the powder paint particles are discharged into the space to be driven toward the; surface to be painted. Thus, these particles are again strongly charged in the concentrated field at the edge 62 and move effectively toward the object to be painted. With this construction the corona discharge electrode 59 need not be connected to a power source but may instead have a floating construction. With such a construction the corona discharge electrode 59 will receive the charges of the powder paint particles passing in contact with the inner surface of the corona discharge electrode 59, so as to be maintained at high potential, as described above.

Figure 13:
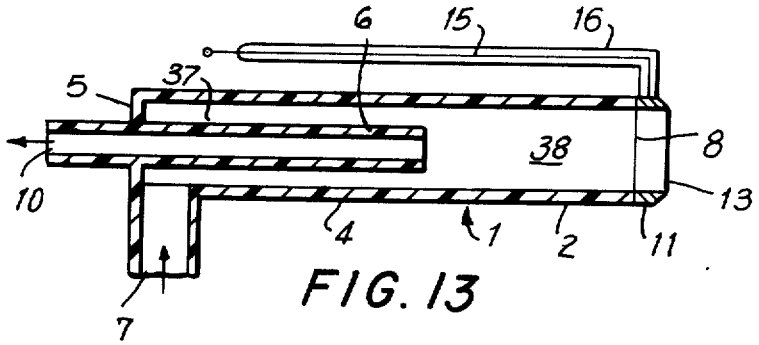
FIGS. 13–16 respectively illustrate schematically, in sectional elevations, further embodiments of cyclone means according to the invention.

FIG. 13 shows another embodiment of a cyclone means which may be used in a manner similar to the embodiment of FIG. 4. With the embodiment of FIG. 13 the feed cylinder 4, forming the exterior cylinder of the cyclone means 1, is made of an insulating material and has a constant diameter throughout its length. Both the feed cylinder 4 and the exhaust cylinder 6 have a sufficiently great length to provide for sufficient insulation distance. In addition, the circular corona discharge electrode 11, which is made of a high resistance material and which has a sharp metallic circular edge 13, is situated at the outlet 8 of the feed cylinder 4 composed in this case only of the constant-diameter cylinder 2. The various parts shown in FIG. 13 and having the same reference characters as in FIG. 4 perform the same functions as in FIG. 4. Thus, the embodiment of FIG. 13 will operate in the same way as the embodiment of FIG. 4, so that further explanation is omitted. It is only pointed out that in connection with the embodiment of FIG. 13 since the feed cylinder 4 is composed only of the cylinder 2 which has a constant diameter, this construction is less expensive than a feed cylinder 4 as shown in FIG. 4, for example. However, because the tapering or conical section 3 is omitted from FIG. 13, the capability of separating powder paint particles of a given size is less than in the case of FIG. 4, and thus the critical particle size to be separated is larger.

Figure 14:
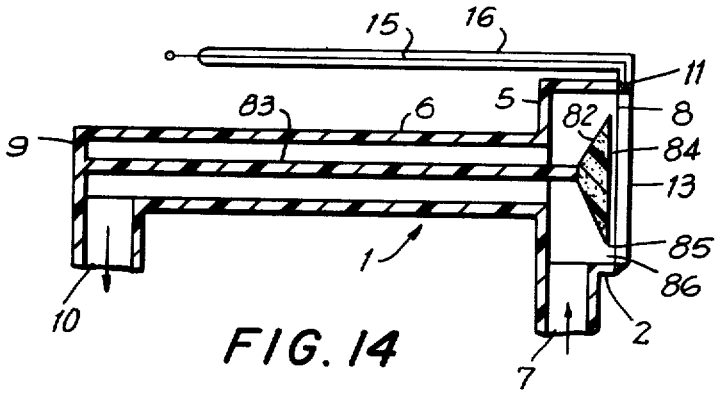

With respect to the embodiment shown in FIG. 14, which is a modification of that shown in FIG. 13, the feed cylinder of the cyclone means 1 is composed only of a relatively short cylinder 2 of constant diameter but with a diameter larger than in the above embodiments. Thus, with the embodiment of FIG. 14 the powder paint will issue from a larger outlet 8 toward the object to be painted. This particular embodiment is suitable for use when the object to be painted is large or when a relatively large number of objects are to be painted in a short time. The various reference characters shown in FIG. 14 which are the same as those of FIG. 13 designate the same elements which function in the same way. With the embodiment of FIG. 14, however, the feed cylinder 2 is much shorter than in the other embodiments so that it has a lesser weight. On the other hand, the exhaust cylinder 6 is much longer to provide for sufficient insulation distance. Moreover, with the embodiment of FIG. 14, the exhaust cylinder 6 does not extend into the feed cylinder. The exhaust cylinder 6 of FIG. 14 extends only away from the feed cylinder 2 so that the interior of the cylinder 2 will not become too narrow to provide an undesirable disturbance in the spiralling air flow. If desired, however, it is of course possible to provide an exhaust cylinder 6 which extends through a certain appropriate distance into the cylinder 2, if necessary.

The embodiment of FIG. 14 has a conical body 82 made of an insulating material and situated concentrically within the outlet 8 having its vertex directed toward the exhaust cylinder 6 while the larger base 84 of the conical member 82 is directed outwardly toward the object to be painted. This conical body 82 is carried at the region of its vertex by an elongated rod 83 made of an insulating material and extending along the common axis of the cylinders 2 and 6. The rod 83 is fixedly carried by the end 9 of the exhaust cylinder 6. The circumference or rim 85 at the base 84 of the conical body 82 defines with the cylinder 2, at the outlet 8 thereof, an annular gap 86 through which the powder paint separated in the cyclone means flows to issue toward the right, as viewed in FIG. 14, so as to travel toward the object to be painted. The conical body 82 serves to prevent a large amount of air from being sucked into the exhaust cylinder 6 from the outside through the outlet 8, so as to prevent also in this way the air which reaches the exhaust cylinder 6 from carrying powder paint. In this way a lowering of the separating efficiency is avoided. At the same time, the conical body 82 functions as a valve to adjust the pressure in the cyclone separator at an appropriate value, as is apparent from FIG. 14.

Figure 15:
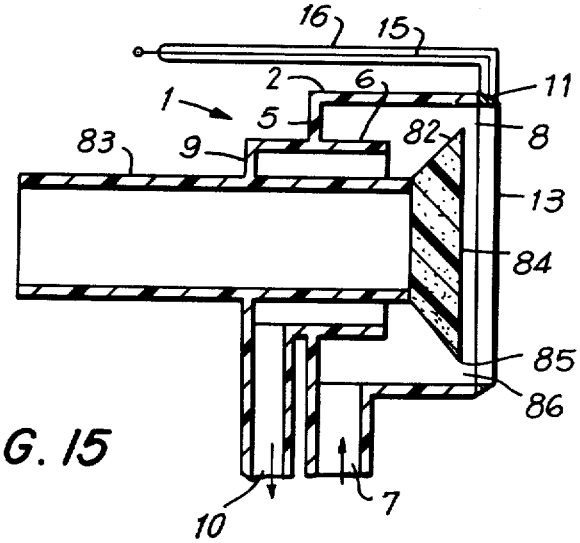

The embodiment of the invention which is shown in FIG. 15 is a further modification of that shown in FIG. 14. In FIG. 15 the exhaust cylinder 6 does indeed extend into the feed cylinder 2 while having at the exterior of the latter only a relatively short length. In FIG. 15 an axially extending brace or supporting structure 83 in the form of an insulating cylinder carries the conical body 82 which in this embodiment is more of a frustoconical configuration than in the case of FIG. 14. This axial support 83 for the conical body 82 extends through a considerable distance to the exterior beyond the wall 9 of the exhaust cylinder 6 so as to provide in this way the insulating distance. The structure of FIG. 15 is suitable when the amount of powder paint issuing from the outlet 8 is larger than with the embodiment of FIG. 14. The various reference characters shown in FIG. 15 designate elements which are designated by the same reference characters in FIG. 14 and which have the same function so that further description is omitted.

Figure 16:
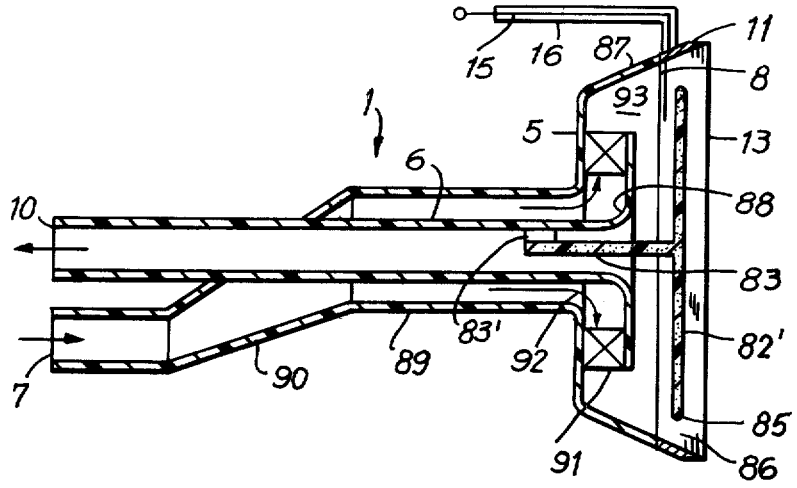

FIG. 16 shows a further modification of the structure of FIG. 15. In the embodiment of FIG. 16 the whirling or spiralling motion of the air and powder within the feed cylinder is achieved not by the tangential connecting structure for the conduit means 23 at the inlet to the feed cylinder, but rather by way of suitable guide vanes. With the embodiment of FIG. 16, the structure corresponding to the feed cylinder of FIG. 15 includes a cup-shaped portion 87 in the form of a circular truncated cone. It will be noted that in this embodiment the feed cylinder of the cyclone means 1 has its largest diameter at the outlet 8. With the embodiment of FIG. 16, the exhaust cylinder 6 terminates in the feed cylinder 87 in a trumpet-shaped portion 88. The exhaust cylinder 6 is surrounded by a tubular extension 89 of the feed cylinder 87, the tubular portion 89 and the feed cylinder 87 being interconnected by the wall portion 5 as illustrated in FIG. 16. This tubular portion 89 of the feed cylinder of the cyclone means of FIG. 1 is made of an insulating material and at its right end opens directly into the portion 87. At its left end the tubular portion 89 communicates with the end portion 7 of the conduit means 23, this construction having the tubular inlet 90 extending between the portion 7 and the tubular portion 89, and the exhaust cylinder 6 extends fluid-tightly through a wall portion of the connecting structure 90 which forms the inlet. Between the trumpet shaped portion 88 of the exhaust cylinder 6 and the region where the end wall 5 joins the tubular portion 89, a plurality of guide vanes 91 are provided so as to produce the spiralling, whirling motion of the air and powder travelling through the space defined between the portion 88 of cylinder 6 and the wall 5 and adjoining portion of the tubular part 89.

In the embodiment of FIG. 16 there is a circular plate of disc 82' situated in a plane normal to the axis of the cylinder 6 and made of an insulating material. This disc 82' is supported by a rod 83 which in turn is carried by a brace 83' fixed to and projecting inwardly from a wall portion of the cylinder 6 which is connected to the conduit 10 in the manner shown schematically in FIG. 16. Thus, the disc 82' takes the place of the conical body 82 of FIG. 15.

The powder paint carrying air current flowing through the pipe 7 along the inlet 90 into the cyclone means 1 reaches the clearance space between the exhaust cylinder 6 and the tubular feed portion cylinder 89, this air and powder paint suspended therein flowing in the manner indicated by the arrows 92 so as to reach the guide vanes 91 which provide a strong spiralling or whirling motion in the flowing air and powder paint. In this way the air and powder paint are introduced into the space 93 in the feed cylinder portion 87. The powder paint is separated from the air by centrifugal force, and is supplied toward the right, as viewed in FIG. 16 through the gap 86, while the air is sucked from the inside of the body 87 into the trumpet-shaped inlet portion 88 of the exhaust cylinder 6 to flow therethrough to the conduit 10. Of course all of the various parts of FIG. 16 which have the same reference characters as those of FIG. 15 function in the same way so that further description is omitted. Thus, the operation of the structure of FIG. 16 is clearly apparent without further explanation.

Figure 17:
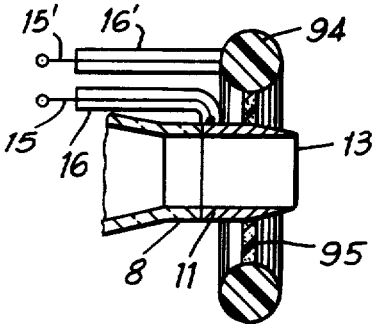
FIGS. 17 and 18 respectively illustrate fragmentarily in sectional elevations further embodiments of corona discharge means, capable of being adjusted with respect to the current.

Referring now to FIG. 17, there is shown therein an embodiment according to which the corona current from the corona discharge electrode 11 at the outlet 8 is capable of being controlled by adjusting the potential of an auxiliary electrode situated in the vicinity of the corona discharge electrode 11. Thus FIG. 17 shows the outlet 8 through which the paint powder is delivered to the object to be painted. The corona discharge electrode 11 is made of a high-resistance material and is situated concentrically with the outlet 8 directly in advance thereof. This discharge electrode 11 has a sharp front edge 13 in the form of a metallic ring and is connected to a DC high-tension supply through the cable 16 by way of the resistance feeder conductor 15 provided for safety purposes. Thus, corona discharge will be provided toward the grounded object which is to be painted and which is situated in front of the electrode 11 of FIG. 17.

The auxiliary ring electrode 94 of FIG. 17 surrounds the electrode 11, while being concentric therewith. This auxiliary ring electrode 94 is made of a high-resistance material and is provided for field adjustment purposes. The electrode 94 is supported by a ring 95 of insulating material and is of course concentric with the corona discharge electrode 11. The electrode 94 is connected to another variable DC high-tension supply by way of the cable 16' which has in its interior the conductor 15' as illustrated schematically in FIG. 17. By way of this adjustable DC high-tension supply, which is not illustrated, it is possible to make the voltage of the auxiliary electrode 94 lower than the potential of the corona discharge electrode 11 (close to ground potential), and in this case the field concentration toward the edge 13 increases so that corona current increases. On the other hand, if the adjustment is such as to make the voltage of auxiliary electrode 94 higher, the corona current discharge will decrease. Therefore, the voltage of the auxiliary electrode 94 can be controlled according to the nature of the powder paint and the required thickness of the layer of paint which is to be deposited, to obtain in this way at all times a uniform layer of paint of superior quality having the required thickness.

Figure 18:
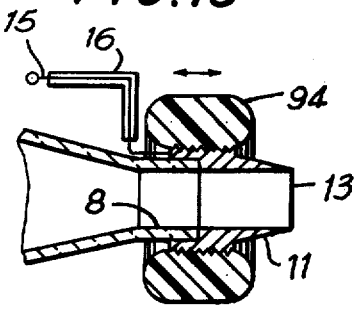

FIG. 18 shows an embodiment where the control of the corona current is brought about by way of changing the position of an auxiliary electrode. In this embodiment the corona discharge electrode 11, which may be the same as that of FIG. 17, is provided with an exterior thread and is directly surrounded by a cylindrical auxiliary electrode 94 having rounded ends, as illustrated in FIG. 18. This electrode 94 of FIG. 18 is made of a high-resistance material and has an internal thread mating the the external thread of the electrode 11. Thus it is possible to turn the electrode 94 with respect to the electrode 11 so as to shift the electrode 94 axially toward the right or left, as shown by the double-headed arrow in FIG. 18. In the event that the electrode 94 of FIG. 18 is shifted toward the right in a forward direction, as viewed in FIG. 18, then the field concentration at the edge 13 of electrode 11 becomes weaker and corona discharge decreases. On the other hand, if the electrode 94 is shifted toward the left, as viewed in FIG. 18, then the corona current will increase.

Figure 19:
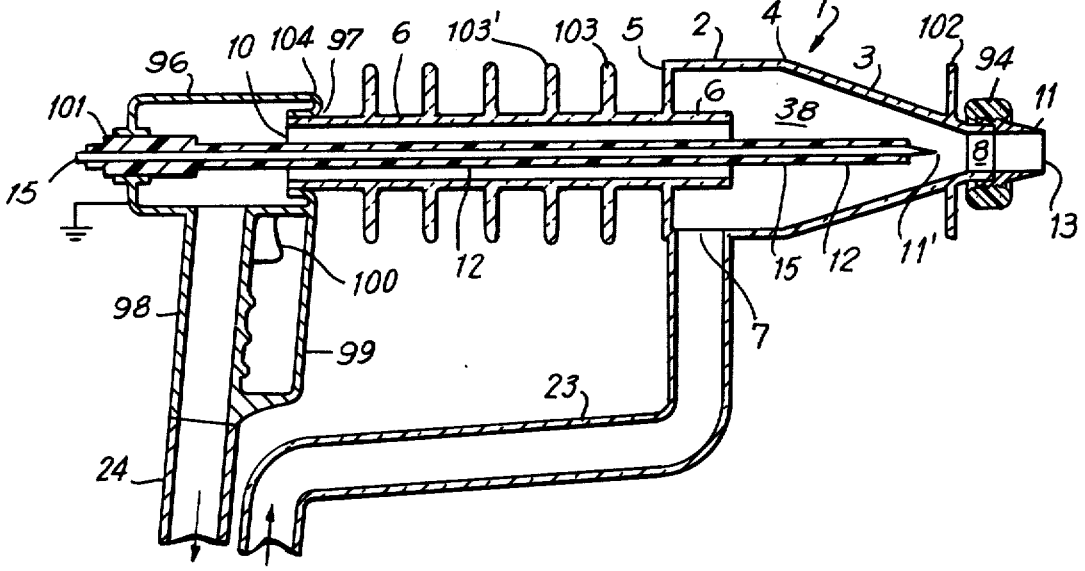
FIGS. 19 and 20 show further embodiments of the invention, respectively, utilizing corona discharge means similar to those of FIG. 17 and 18.

FIG. 19 illustrates an embodiment of the invention utilizing an auxiliary electrode for controlling corona current as shown in FIG. 18. Various components of FIG. 19 have the same reference characters as corresponding components in FIGS. 1A and 18, and these components with the same reference characters function in the same manner in FIG. 19 as in FIGS. 1A and 18. In the embodiment of FIG. 19, the exhaust cylinder 6 extends through a considerable distance beyond the feed cylinder 4 of the cyclone means 1, so as to achieve in this way a desirable insulation distance. In FIG. 19 the conduit 10 which receives air from the exhaust cylinder 6 extends with a tight fit into an opening 97 formed at the front end of a metallic basic casing 96 which is grounded. This basic casing 96 has a metallic grip 98 forming a handle for the operator. This handle or grip 98 of the casing 96 is hollow and tubular so that air flowing out of the conduit 10 can continue to flow through the tubular handle 98 to be received, as illustrated in FIG. 19, in the conduit 24 of the return conduit means described above in connection with FIG. 1A. A trigger guard 99 is provided in front of the handle 98, and in the space between the handle and trigger guard is a trigger 100 available to be manipulated by the operator. The trigger guard 99 acts to protect an individual while the trigger 100 is operatively connected with a relay for completing a circuit through the high-tension supply when the operator operates the trigger 100. The high resistance feeder conductor 15 provided for safety purposes, together with the insulating covering 12, extend through a rear opening 101 of the basic casing 96 and then axially along the conduit 10 and exhaust cylinder 6 as well as the feed cylinder 4 in the manner illustrated in FIG. 19. The front end of the conductor 15 is provided with a sharp tip 11' which is exposed just behind the outlet 8 so as to provide in this way corona discharge toward the cylindrical corona discharge electrode 11, thus feeding high voltage to the electrode 11. The feed cylinder 4 is provided just to the rear of the outlet 8 with an annular fin or collar 102 while a similar series of fins or collars are provided at the exterior of the cylinder 6, these fins extending outwardly away from the cylinders 4 and 6 and being made together with the cylinders of an insulating material so that by way of these fins 102, 103, 103' the high-tension insulation between the corona discharge electrode 11 and the casing 96 is improved. The front end region 104 of the casing 96 is rounded so as to prevent occurrence of a corona discharge at this location. The manner in which the powder gun of FIG. 19 operates is clear so that further explanation is omitted.

Figure 20:
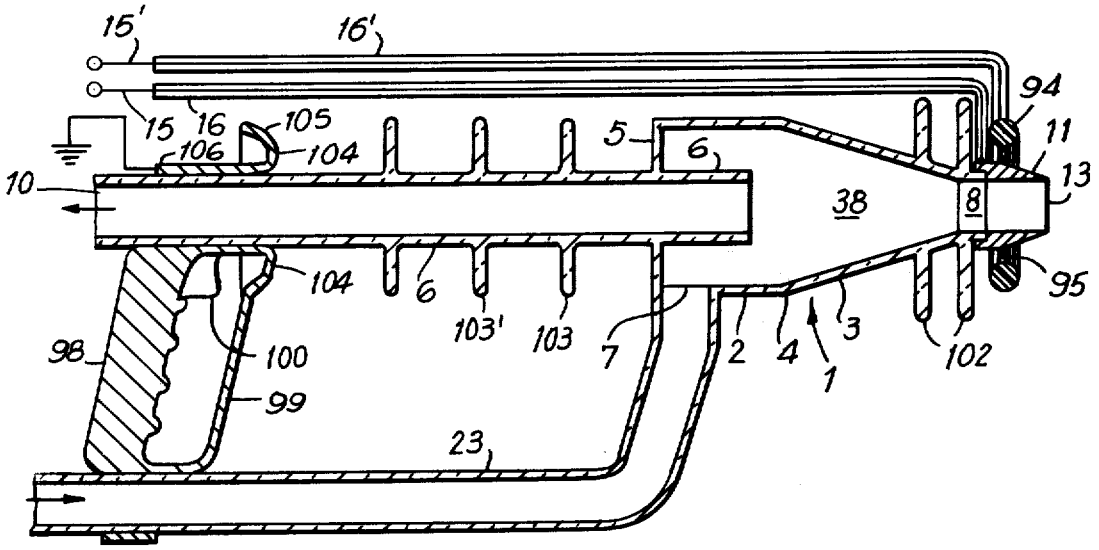

Referring now to FIG. 20, the embodiment illustrated therein utilizes an auxiliary electrode for controlling the corona current as illustrated in FIG. 17. In this case also the various reference characters which are the same as those appearing in FIGS. 17 and 19 indicate components which perform the same functions. With the embodiment of FIG. 20 there is no basic casing 96. The air is discharged from the exhaust cylinder 6 into the conduit 10 and from the latter through the remaining return conduit means as shown in FIG. 1A and described above. The rear end region of the cylinder 6 where it forms a continuation of the conduit 10 is supported by a grounded metallic cylinder 106 which has the grip 98 together with the guard 99 and the trigger 100. It will be noted that this cylinder 106 still has a rounded front end region 104 providing the above prevention of corona discharge. The rounded front portion 104 projecting outwardly from the cylinder 106 has an upper portion 105 provided for protective purposes.

In these embodiments of FIGS. 19 and 20, the exhaust cylinder 6 extends through a considerable distance rearwardly beyond the feed cylinder 4 of the cyclone means 1 so as to maintain the desirable high-tension insulation, and the fins or collars 103 and 103' contribute to this effect. However, it is possible instead to increase the length of the feed cylinder 4 so as to provide the latter with an elongated construction at the region of the outlet 8 and to situate a series of collars at this region. It will be noted that in FIG. 20 an additional collar or fin 102 is situated at this region. Thus, these fins or collars of insulation material can be situated either at the region of the outlet 8 or along the cylinder 6 or at both regions as shown in FIGS. 19 and 20.

Figure 21:
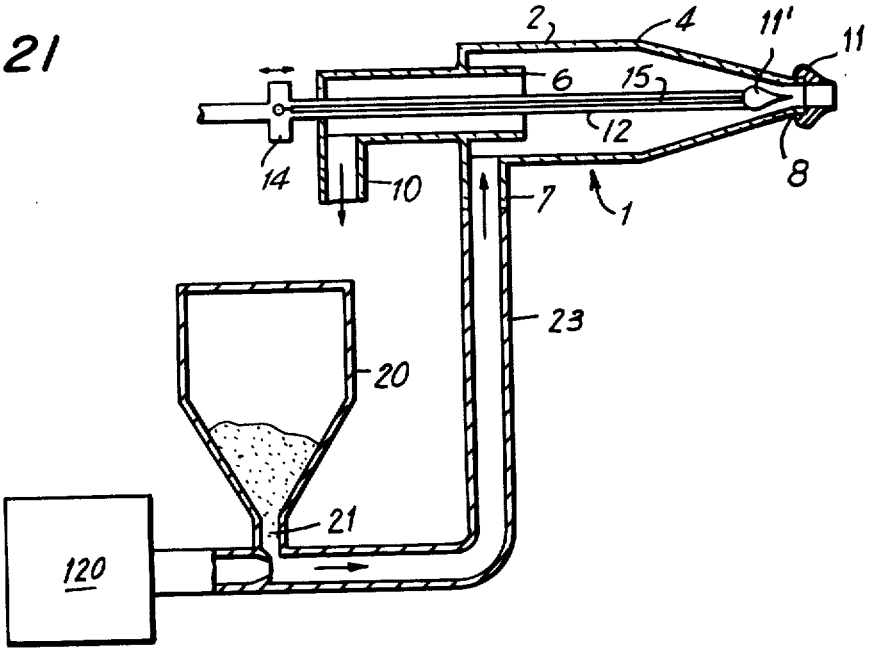
FIG. 21 is a schematic partly sectional elevation of a still further embodiment of an apparatus according to the invention.

FIG. 21 is a schematic illustration of a further embodiment of the invention according to which the air which carries the powder paint flows along an open circuit rather than a closed circuit. In this case there is still an injector section with the powder paint being conveyed from the supply means 20 out of the port 21 thereof and along the conduit means 23 to the end 7 thereof which communicates tangentially with the feed cylinder 4 at the inlet thereof as described above. The source of air under pressure which flows through the conduit means 23 is derived from an air supply means 120 such as a blower, compressor, high pressure pneumatic piping in a plant, or the like. In this way the powder paint is pneumatically conveyed from the storage tank 20 to the inlet of the feed cylinder 4 of the cyclone means 1. The flow of air at the outlet 8 is adjusted by way of a needle valve 11' situated within the feed cylinder 4 just behind the outlet 8. The exhaust cylinder 6 of FIG. 21 receives air from the interior of the feed cylinder 4 and discharges this air through the conduit 10 directly to the outer atmosphere. In the embodiment of FIG. 21 the needle valve 11' also functions as the feed corona discharge electrode. Thus this component 11' is connected through a conductor 15 situated in the rod 12 to the source of power. The electrode 11' of FIG. 21 has its tip directed toward the outlet 8 which carries an electrode 11 so that the operation with respect to corona discharge is similar to that described above in connection with FIG. 19. Of course the conductor 15 has a currentlimiting resistance for safety purposes. Because of the conical configuration of the electrode 11' it is capable of additionally functioning as a valve for controlling the flow out through the outlet 8. The distance between the outlet 8 and the valve 11' can be adjusted by way of the knob 14 which is available to the operator so that the rod 12 together with the conductor 15 and electrode 11' can be axially shifted. Thus, by way of the knob 14 it is possible to adjust the location of the valve 11' so as to adjust the amount of air discharging together with powder to the right from the outlet 8, as viewed in FIG. 21. In this way, if the component 11' is situated sufficiently close to the outlet 8, most of the air entering into the feed cylinder 4 can be released to the outer atmosphere through the exhaust cylinder 6 and conduit 10 without particularly sucking this air out of the interior of the feed cylinder 4. In this way it is possible to omit the return conduit means while at the same time reducing the power required of the air supply means 120.

Figure 22:
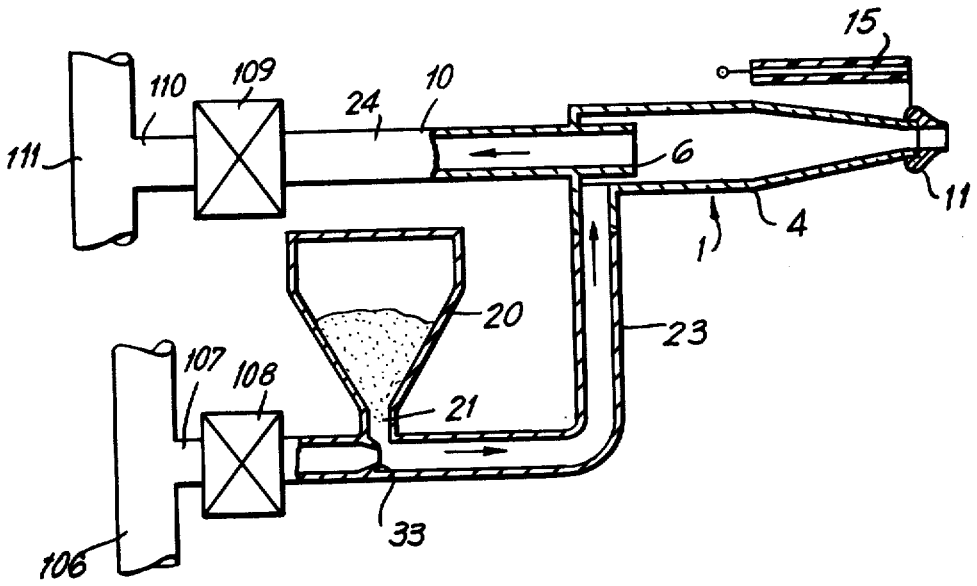
FIG. 22 schematically illustrates a still further embodiment of an apparatus according to the invention.

FIG. 22 illustrates an embodiment of the invention which can be connected with both high pressure pneumatic piping and the vacuum piping which are available in a plant in which the structure of the invention is used. In the embodiment of FIG. 22 those components which are indicated by the same reference characters as in the other embodiments perform the same functions. Shown at the lower left of FIG. 22 is a pipe 106 forming part of a plant and having in its interior air at high pressure which is thus utilized as a source for the air under high pressure in this embodiment. This high pressure air is supplied from the pipe 106 through a branch pipe 107 and a valve 108 into the nozzle 33. Thus by adjusting the valve 108 which forms a pressure regulator, it is possible to provide air at an appropriate constant pressure to be delivered to the nozzle 33 so as to issue therefrom in the form of a jet which sucks the powder through the port 21 of the supply means 20 and conveys the powder then along the conduit means 23 into the feed cylinder 4 as described above. The exhaust cylinder 6 of FIG. 22 communicates through an extension conduit 10 and a conduit portion 24 with a further pressure regulator or valve 109 which through a branch 110 communicates with a pipe 111 of the plant which is connected to a source of the vacuum. In this way it is possible to maintain in the exhaust cylinder 6 an appropriate constant pressure, by way of the regulator 109.

As a result it is possible with this embodiment to maintain the internal pressure within the feed cylinder 4 of the cyclone means 1 at a constant value. Thus by way of these controls the amount of air exhausted through the outlet 8 can be adjusted at an optional value from 0 to somewhat higher than such a minimum value. Thus, with this embodiment also the same functions are maintained as set forth above without providing a closed pneumatic circuit for the air.

While typical embodiments of the electrostatic powder paint apparatus of the invention and the powder gun or cyclone means thereof have been described above and shown in the drawings, it is to be understood that the invention is not necessarily limited to the specific details in that many modifications in the system are of course possible, particularly in the structure of the cyclone means 1, the structure of the powder charging section, the auxiliary electrode, etc. Moreover, the materials used for the respective components are not necessarily limited by those set forth above inasmuch as these materials can be freely selected from many alternatives.

It will be seen that with all of the embodiments of the invention there will issue from the outlet 8 of the feed cylinder 4 toward the object to be painted practically only charged powder paint while almost all of the air which conveys the powder paint toward the outlet 8 is exhausted from the cylinder 4 through the exhaust cylinder 6. By way of the structure described above it is possible with the apparatus of the invention to achieve at all times a smooth and uniform conveying of the powder paint to the feed cylinder 4 with a large quantity of air irrespective of the amount of powder paint supplied from the storage tank, thus assuring a smooth and uniform supply of powder paint from the powder gun with sufficient charging of the powder paint while at the same time eliminating any problems in connection with air which might discharge from the outlet 8 with the powder paint inasmuch as practically no air discharges through the outlet 8 with the powder paint so that there is no creation of undesirable air currents which might hinder the efficient electric deposition of the powder paint. In this way it is possible to achieve a high painting efficiency and high painting quality.

By utilizing a cyclone separator structure for the cyclone means 1, the powder paint is classified so that the relatively coarse particles, the diameter of which is greater than about 10 microns, are discharged to the object to be painted while finer particles which are not desirable for powder painting are exhausted together with air by way of the exhaust cylinder 6. In this way the efficiency of the painting operation is further enhanced.

The storage tank 20 can take the form of a simple hopper as illustrated, although it can also take the form of a tank provided with stirring blades in its central region. In addition, it is possible to provide at the storage tank a fluidized bed of powder paint which can be sucked into the injector section. Any other appropriate type of powder paint supply means can be utilized. The material of the conduit means 23 used for pneumatically conveying the powder paint can be metal, semiconductor material, insulation material, plastics, rubber, or any other material, and in fact a flexible pipe can be used for the conduit means 23. The cyclone means 1 can also have the cylinders 4 and 6 thereof constituted by metal, semiconductor material, insulation material, glass, ceramics, plastics, or any other appropriate material, and materials of this type can be used either singly or in combination.

It is to be noted that in the event that Teflon is used for the conduit means 23 as well as the feed cylinder 4, most of the powder paint can be provided with a considerable positive charge simply by frictional contact with the conduit means 23 and feed cylinder 4. As a result, if the corona discharge electrode is arranged so as to provide positive charging, the powder paint which is charged in this way will have a charge of very high value, so as to achieve an extremely high painting efficiency.

The air supply means can be in the form of a blower, compressor, vacuum pump, suction ejector, or high pressure pneumatic piping, vacuum piping, or the like, or any other appropriate means may be used, and structures of this type can be used either singly or in combination.

While the clean air obtained by separating the powder paint from the air within the feed cylinder 4 may be totally exhausted by way of the exhaust cylinder 6, it is possible by appropriate adjustment of the internal pressure of the feed cylinder 4 to leak a certain amount of the clean air together with the powder paint from the outlet 8 of the feed cylinder 4, so as to achieve in this way also a smooth flow of the powder paint from the outlet 8.

An adjustment for this latter purpose can of course be provided by way of a suitable valve such as a needle valve, as pointed out above. However it is also possible to utilize for this purpose suitable pressure regulators or by controlling the flow through the closed circuit in a manner described above. While it is of course possible simply to discharge the air exhausted by the exhaust cylinder 6 to the outer atmosphere, if this air contains fine particles of powder paint, it is of course preferable to remove these residual particles, as pointed out above. For this purpose the separator cyclone 25 and container 29 are utilized as described above in connection with FIG. 1A. However, it is possible also to use for this purpose a suitable bag filter, electrostatic precipitator, or any other suitable dust collector, capable of preventing release of the fine particles to the outer atmosphere.

Of course the closed circuit described above in connection with FIG. 1A will perfectly prevent contamination of the outer atmosphere.

With respect to the corona discharge electrode utilized in the above embodiments to charge the powder paint, it can have the shape of a needle, a knife, a fine wire, or any other appropriate form with a small radius of curvature, and the material used for the corona discharge electrode can be metal, semiconductor material, conductive plastics, conductive film situated on the surface of an insulator, or any other appropriate material. As has been indicated above, the corona discharge electrode can be situated at any appropriate location along the path of flow of the powder paint, including the part of this path which is situated outwardly beyond the outlet 8 in the region of the latter. For example the corona discharge electrode can be situated at the outlet region of the storage tank 20, inside the conduit means 23, at the region of the inlet of the feed cylinder 4, at the region of the outlet 8 thereof, at the exterior in the region of the outlet 8, etc. Moreover, while one corona discharge electrode can be used it is also possible to use more than one corona discharge elecrode as is apparent from the above description. Of course, the corona discharge electrode can be situated on the outer wall of the exhaust cylinder 6 or on the inner surface of the feed cylinder 4, including the conical section 3 thereof. Where the entire cyclone means 1 or the outlet 8 thereof is maintained at a high potential, the circumferential edge of the outlet 8 itself can be utilized as a corona discharge electrode, or an umbrella-shaped deflector for dispersing powder paint may be situated in front of the outlet 8 and may also serve as the corona discharge electrode. The corona discharge electrode may of course cooperate with an opposed electrode insulated from the corona discharge electrode through an appropriate wall of semiconductor or insulation material, this wall being formed by part of the conduit 23 or part of the cyclone means 1 as described above in the event that these parts are made of a semiconductor or insulator material. By providing high voltage between such electrodes the corona discharge can be promoted so as to increase the extent to which the powder paint is charged. With such a construction either the corona discharge electrode or the opposed electrode may be grounded while the non-grounded electrode is connected to the high-tension supply. However, it is also possible to connect both electrodes to a pair of separate high tension supplies having different voltages. Both of such electrodes may be connected respectively to different output terminals of a single high-tension supply having a pair of output terminals which respectively have different voltages.

The high-tension supply utilized with the structure of the invention can be of any appropriate type. For example it is possible to utilize a combination of a rectifier with the secondary winding (high voltage winding) of a high-tension transformer. It is also possible to utilize a combination of rectifiers and capacitors so as to constitute a multistage cascade voltage multiplying rectifier, or the above combinations may be utilized with high frequency alternating voltage as the power frequency. It is also possible to provide a combination including a piezoelectric vibrator, its drive circuit and a multistage cascade voltage multiplying rectifier, etc. All or some of the above high-tension supplies can be incorporated into the structure of the invention.

With respect to the output current of each high-tension supply, it is of course desirable to arrange an appropriate control circuit, etc. for providing constant current characteristics, or to insert a sufficiently large current-limiting resistance, for example on the order of approximately several hundred to several thousand megohms, at the part of the circuit which is connected directly with the corona discharge electrode and which participates in the feeding of high voltage output of the supply. It is of course possible in addition to form the corona discharge electrode itself of a high resistance material, or to give it the construction of an insulating material the surface of which is coated with a high-resistance covering. It is also possible to provide for the electrode as small a structure as possible, for example in the form of a needle or wire ring, so as to make the effective capacity as small as possible, thus assuring in this way safety to individuals by limiting the current flowing in the event that the apparatus is contacted by an individual. In this way also it is possible to prevent the occurrence of dust explosions by controlling the spark energy which is generated when a grounded object touches the output side.

In particular, the high-tension supply which utilizes the piezoelectric vibrator as the power source has the advantage that a current-limiting resistance may not be particularly provided inasmuch as the output current remains constant and will not exceed a value of several tens of microamperes.

Thus, with arrangements as set forth above the corona current supplied from the discharge electrode can be freely controlled, allowing the corona current value to be set and controlled that a favorable deposition layer of required thickness is formed at the object to be painted. In this way an optimum painting effect is always achieved. Of course, as pointed out above, an additional electrode not for providing corona discharge but for controlling corona current can be provided at the vicinity of the corona discharge electrode or an auxiliary corona discharge electrode, and a DC high voltage with the same polarity as that of the corona discharge electrode or the auxiliary corona discharge electrode can be applied to this additional electrode with the voltage value changed so as to freely control the field strength of the corona discharge electrode or the auxiliary corona discharge electrode. In this way it is possible to freely change the corona current discharge from the corona discharge electrode or from the auxiliary corona discharge electrode. Such corona current control can of course be carried out by making a dimensional change in the arrangement in such a way that the length through which the corona discharge electrode or the auxiliary corona discharge electrode protrude into space or the relative positions between the protruding part of such an electrode and an additional electrode can be utilized to control the corona current by changing the latter. Of course, in all cases the auxiliary discharge electrode and the additional electrode, or the opposed electrode which cooperates with the corona discharge electrode, are made of materials of sufficient resistance for safety purposes or are made of insulating materials coated with high-resistance coverings. Of course, when high voltage is fed to the auxiliary discharge electrode, the additional electrode, or the opposed electrode, a sufficiently large current-limiting resistance on the order of several hundred to several thousand megohms is inserted at the portions directly connected with such electrodes for purposes of safety. Of course the high voltage can be fed either at the exterior of the cyclone means 1 or through the interior thereof. The power feeder ends can be directly connected to electrodes as set forth above either through the above current-limiting resistances or the ends of the current-limiting resistances may be formed themselves as corona discharge electrodes for the purpose of generating corona discharge from these portions to the respective electrodes for feeding voltage. In particular when the power feeder section (the current-limiting resistance) is situated inside the cyclone means 1, it can be located at the axis of the cyclone means with its end in the form of a conical body terminating in a tip which provides the corona discharge and thus enabling this structure also to serve as a needle valve as pointed out above in connection with FIG. 21.

Of course, even if a corona discharge electrode is omitted, the strong friction between the powder paint and the walls of the blower, the conduit means 23, and the cyclone means 1 will cause the power paint to become heavily charged. In such cases the corona discharge electrode can be omitted because the powder paint becomes in any event heavily charged so as to be effectively deposited on the object to be painted.

In order to form an electric field which will effectively drive the charged powder paint to the grounded object which is to be painted, the cyclone means 1 itself or the outlet thereof from which the powder paint issues may be connected as a conductor or semiconductor to the high voltage supply having the same polarity as the powder paint or an auxiliary electrode may be provided near or around the outlet 8 to be connected with the high voltage supply. In the case where, as with some of the embodiments described above, the corona discharge electrode is situated in the path of flow of the air and paint powder in advance of the cyclone means 1, for charging the powder before it reaches the cyclone means 1, it is preferable to provide a polarity which is the same as the polarity of the powder charged by friction in the cyclone means 1. Furthermore, in the case where the corona discharge electrode is situated in advance of the cyclone means 1 for charging the powder, the particles of charge powder are conveyed in the air current, so that the charge is carried in this way to the cyclone means 1 and an electrostatic generator is provided based on a kind of electric fluid mechanics. Therefore, with such a construction, since the cyclone means 1 can be maintained at a high potential with the same polarity as that of the charged powder without the provision of a high voltage power supply, the latter can be omitted. Moreover, in this case, if the corona discharge electrode is connected to the feed cylinder 4 or to a conductor at the outlet 8 or to an auxiliary electrode within the cyclone means 1, to partially collect the powder paint charges, then the cyclone means 1, or the conductor at the outlet 8, or the auxiliary electrode can be maintained at a high potential with the same polarity as that of the charged powder paint without a high voltage supply. Various structures are available for supplying the powder paint from the storage tank to the conduit means 23 to be pneumatically conveyed therein, and in this connection it is particularly preferable to utilize a constant quantity feeding of powder which permits achievement of a further improvement in the painting quality free from pulsation of the powder.

What is claimed is:

1. An electrostatic powder painting apparatus, comprising cyclone means for directing powder paint toward a surface which is to be painted, said cyclone means including a feed cyclinder having an open outlet where in a conventional cyclone separated solid particles would be collected and through which instead powder paint is adapted to be fed toward said surface and, spaced from said outlet, an inlet for receiving air and powder paint suspended therein, said cyclone means including a whirling means operatively connected to said feed cylinder for providing for the air travelling along the interior thereof from the inlet toward the outlet a rotary whirling motion for feeding powder paint suspended in the air centrifugally along the inner surface of said feed cylinder from said inlet toward and through said outlet thereof, said cyclone means also including an exhaust cylinder of a diameter smaller than said feed cylinder communicating coaxially with the interior of said feed cylinder so that air spaced from the inner surface of said feed cylinder can flow out of the interior thereof through said exhaust cylinder, whereby the powder paint issuing from said open outlet travels therefrom toward the surface which is to be painted without the air which flows out through said exhaust cylinder, conduit means communicating with said inlet for conveying thereto air with powder paint suspended therein, air supply means communicating with said conduit means distant from said inlet for supplying to the interior of said conduit means air to flow therethrough to said inlet and into said feed cylinder, powder paint supply means communicating with said conduit means between said air supply means and said inlet for supplying to the interior of said conduit means powder paint to be suspended in air flowing along the interior of said conduit means, so that the portion of said conduit means extending from said powder paint supply means to said inlet and said feed cylinder provides for the powder paint a path of flow extending along the interior of said conduit means from said powder paint supply means to said inlet and from said inlet through the interior of said feed cylinder through and at least slightly beyond said outlet of said feed cylinder, and charging means situated at the region of said path of flow for electrostatically charging the powder paint travelling along said path of flow with unipolar ions for driving the charged powder paint electrostatically toward the surface to be painted so as to become deposited thereon.

2. The combination of claim 1 and wherein said charging means is a corona discharge means.

3. The combination of claim 1 and wherein a dust-separating means communicates with said exhaust cylinder for separating from air flowing therethrough fine particles of powder paint suspended in air exhausted from said feed cylinder through said exhaust cylinder.

4. The combination of claim 1 and wherein a return conduit means communicates with said exhaust cylinder and with said air supply means for returning air from said exhaust cylinder to said air supply means, to provide a closed circuit for the air.

5. The combination of claim 4 and wherein a valve means communicates with said circuit for supplying thereto makeup air to compensate for air discharged through said outlet of said feed cylinder.

6. The combination of claim 1 and wherein a valve means is situated at the region of said outlet of said feed cylinder for adjusting the flow of air through said outlet.

7. The combination of claim 1 and wherein said air-supply means, said conduit means, and said exhaust cylinder form a plurality of components through which air is adapted to flow, and valve means operatively connected with at least one of said components for maintaining a substantially constant air pressure in said feed cylinder.

8. The combination of claim 1 and wherein a cyclone separator means communicates with said exhaust cylinder for separating from air flowing therethrough particles finer than those fed toward and through said outlet of said feed cylinder.

9. The combination of claim 1 and wherein an additional conduit means communicates with said exhaust cylinder for receiving air therefrom, and deionizer means cooperating with said additional conduit means for neutralizing charges of particles suspended in air flowing through said additional conduit means.

10. The combination of claim 2 and wherein said feed cylinder has a central axis, said corona discharge means including an electrode extending along said axis, and moving means operatively connected with said electrode for moving the latter along said axis to adjust the position of said electrode.

11. The combination of claim 2 and wherein said corona discharge means is situated at an inner surface of said feed cylinder.

12. The combination of claim 2 and wherein said corona discharge means is situated at the region of said outlet of said feed cylinder.

13. The combination of claim 12 and wherein said feed cylinder has a central axis, said corona discharge means being situated beyond said feed cylinder adjacent said outlet and being of a conical configuration, having a base end distant from said outlet and a vertex end nearer to said outlet than said base end, moving means connected to said corona discharge means for adjusting the latter along said axis, and said base end of said corona discharge means having a sharp circumferential edge to form a corona discharge section, the powder paint issuing from said outlet becoming dispersed along said corona discharge means.

14. The combination of claim 2 and wherein said exhaust cylinder has an inner end situated in the interior of said feed cylinder, and said corona discharge means including an annular member carried by said exhaust cylinder at said inner end thereof, extending along said inner end of said exhaust cylinder, and having a sharp edge.

15. The combination of claim 2 and wherein said corona discharge means includes an annular member situated at and extending along said outlet of said feed cylinder.

16. The combination of claim 15 and wherein said corona discharge means is in the form of a wire ring electrode.

17. The combination of claim 2 and wherein said feed cylinder has a central axis, said corona discharge means including an electrode situated in said feed cylinder along said axis thereof and terminating in a tip situated inwardly of said outlet, and an elongated conductor extending along said axis and connected to said electrode distant from said tip thereof for supplying power thereto.

18. The combination of claim 17 and wherein an additional electrode is situated at and surrounds said outlet of said feed cylinder for providing corona discharge between said electrodes.

19. The combination of claim 2 and wherein said corona discharge means is situated outwardly beyond said feed cylinder at the region of said outlet thereof.

20. The combination of claim 2 and wherein said corona discharge means is situated at the region of said inlet.

21. The combination of claim 2 and wherein said corona discharge means is situated at the region where said powder paint supply means communicates with said conduit.

22. The combination of claim 2 and wherein said conduit means has between said powder paint supply means and said inlet of said feed cylinder a tubular wall portion having a central axis, said corona discharge means including an inner electrode situated at said central axis of said tubular wall portion and an outer electrode surrounding said tubular wall portion of said conduit means.

23. The combination of claim 2 and wherein a power-supply means is operatively connected with said corona discharge means for supplying powder thereto, said power-supply means including a constant-current supply with a piezoelectric vibrator.

24. The combination of claim 1 and wherein said charging means is formed at least in part by a portion of said feed cylinder which cooperates at its inner surface frictionally with powder paint for electrostatically charging the same.

25. The combination of claim 24 and wherein said corona discharge means also includes an electrode situated at said outlet of said feed cylinder.

26. The combination of claim 25 and wherein said corona discharge means includes a further electrode for current collection situated along the interior of said feed cylinder.

27. The combination of claim 2 and wherein said conduit means where it extends from said powder paint supply means to said inlet and said feed cylinder together form an elongated tubular enclosure through which air and powder paint travel, said corona discharge means including an inner electrode situated in said tubular enclosure, an outer electrode surrounding said inner electrode and carried by a wall portion of said tubular enclosure, and a third electrode situated at the region of said outlet of said feed cylinder, additional corona discharge electrode means situated adjacent said third electrode, and power supply means operatively connected with said additional corona discharge electrode means for providing at the latter a pulsating voltage creating between said outlet and the surface to be painted a DC field having a pulsating ion current.

28. The combination of claim 27 and wherein both of said corona discharge means have electrically connected thereto a current-limiting resistance.

29. The combination of claim 27 and wherein both of said corona discharge means include materials of high electrical resistance.

30. The combination of claim 2 and wherein said corona discharge means includes an electrode of small cross section having a relatively small effective capacity.

31. The combination of claim 2 and wherein corona discharge means includes an electrode for providing corona discharge and composed of a metallic element such as a needle, wire, or the like, having a small effective capacity.

32. The combination of claim 2 and wherein said corona discharge means includes a corona discharge electrode and adjacent to the latter an auxiliary electrode and a means connected with said auxiliary electrode for applying thereto a variable high voltage with a potential different from that of said corona discharge electrode for controlling corona current.

33. The combination of claim 2 and wherein said corona discharge means includes a corona discharge electrode and adjustably connected thereto an auxiliary electrode the position of which relative to said corona discharge electrode can be adjusted for controlling corona current.

34. The combination of claim 1 and wherein said whirling means includes an end portion of said conduit means operatively connected tangentially to said feed cylinder for directing air with powder paint suspended therein tangentially into said feed cylinder at said inlet thereof to create the whirling flow.

35. The combination of claim 1 and wherein said whirling means includes in the interior of said feed cylinder vanes which act on air flowing in said feed cylinder to provide the rotary whirling motion.

36. The combination of claim 1 and wherein said exhaust cylinder extends partly into said feed cylinder.

37. The combination of claim 1 and wherein said exhaust cylinder is situated in its entirety outwardly beyond said feed cylinder.

38. The combination of claim 2 and wherein said corona discharge means includes at least one wire extending helically along an inner surface of said feed cylinder.

39. The combination of claim 1 and wherein said feed cylinder is of a constant diameter throughout its length.

40. The combination of claim 1 and wherein said feed cylinder has between said inlet and outlet thereof but at the region of said inlet an elongated portion of constant diameter and between said elongated portion of constant diameter and said outlet a tapering frustoconical portion the smallest end of which forms said outlet.

41. The combination of claim 2 and wherein said corona discharge means includes an inner electrode situated in said feed cylinder and an outer electrode in the form of a disc fixed to said feed cylinder at said outlet thereof and surrounding said outlet.

42. The combination of claim 1 and wherein said feed cylinder has a substantially constant diameter throughout its length, and a frustoconical member situated in said feed cylinder adjacent said outlet thereof concentrically with said feed cylinder with said frustoconical member having opposed ends one of which is larger than the other and situated nearer to said outlet than said other end, said larger end of said frustoconical member defining with said feed cylinder an annular gap through which powder paint flows to the exterior of the feed cylinder toward the surface which is to be painted.

43. The combination of claim 1 and wherein said feed cylinder has its maximum diameter at said outlet thereof, said feed cylinder tapering inwardly from said outlet therof, said feed cylinder having a central axis extending centrally through said outlet, and a plate situated at said outlet and surrounded thereby, said plate being normal to said axis and terminating in an outer periphery spaced inwardly from said feed cylinder at said outlet thereof for defining with said outlet of said feed cylinder an annular gap through which powder paint flows toward the surface to be painted.

44. The combination of claim 2 and wherein said exhaust cylinder communicates freely with the outer atmosphere to discharge to the outer atmosphere air from the interior of said feed cylinder, said feed cylinder tapering toward said outlet thereof and having its minimum diameter at said outlet, a tapered valve member situated in said feed cylinder adjacent said outlet thereof, coaxially with said feed cylinder, said tapered valve member terminating in a tip directed toward said outlet and having a large end distant from said outlet.

45. The combination of claim 44 and wherein an adjusting means is operatively connected with said tapered valve member for adjusting the latter axially of said feed cylinder.

46. The combination of claim 45 and wherein said tapered valve member forms part of said corona discharge means.

47. The combination of claim 1 and wherein said air supply means communicates with said conduit means for supplying air under pressure thereto, a source of vacuum communicating with said exhaust cylinder for sucking air therethrough from the interior of said feed cylinder, and a pair of valve means one of which is connected between said air supply means and said conduit means and the other of which is connected between said exahust cylinder and said source of vacuum, said pair of valve means being adjustable for maintaining a given pressure in said feed cylinder.

48. The combination of claim 2 and wherein said corona discharge means includes a pair of electrodes one of which is at said outlet of said feed cylinder and the other of which is in the interior of said feed cylinder at the region of said outlet thereof, said feed cylinder and exhaust cylinder forming a pair of coaxial components extending through a substantial distance beyond said outlet of said feed cylinder, a grounded member engaging said exhaust cylinder distant from said feed cylinder, said components being made of material for providing high-tension insulation and at least one of said components carrying at its exterior at least one fin which surrounds said one component and projects outwardly from the latter to contribute to said high-tension insulation.

49. The combination of claim 48 and wherein said fin is situated at said feed cylinder adjacent said outlet thereof.

50. The combination of claim 49 and wherein said exhaust cylinder carries additional fins between said feed cylinder and said grounded member.

51. The combination of claim 48 and wherein said grounded member is in the form of a handle.

52. The combination of claim 1 and wherein said feed cylinder and conduit means form a pair of components at least one of which is made of a material forming part of said charging means and cooperating frictionally with the powder paint for electrostatically charging the same with a given polarity.

* * * * *